US010818993B2

(12) United States Patent
Shimura

(10) Patent No.: US 10,818,993 B2
(45) Date of Patent: Oct. 27, 2020

(54) BRANCH CIRCUIT

(71) Applicant: CANON KABUSHIKI KAISHA, Tokyo (JP)

(72) Inventor: Hajime Shimura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 24 days.

(21) Appl. No.: 16/202,502

(22) Filed: Nov. 28, 2018

(65) Prior Publication Data

US 2019/0165442 A1 May 30, 2019

(30) Foreign Application Priority Data

Nov. 29, 2017 (JP) ..... 2017-229364

(51) Int. Cl.

| | |
|---|---|
| ***H01P 3/02*** | (2006.01) |
| ***H01P 5/02*** | (2006.01) |
| ***H01P 1/203*** | (2006.01) |
| ***H01P 1/20*** | (2006.01) |

(52) U.S. Cl.

CPC ..... *H01P 3/026* (2013.01); *H01P 1/20381* (2013.01); *H01P 5/02* (2013.01); *H01P 1/20* (2013.01)

(58) Field of Classification Search

CPC ..... H01P 3/026; H01P 1/20381; H01P 5/02; H01P 1/20; H01P 5/00; H01P 3/08; H01P 3/02; H01P 5/12; H01P 1/203

USPC ..... 333/137

See application file for complete search history.

(56) References Cited

U.S. PATENT DOCUMENTS

| | | | | |
|---|---|---|---|---|
| 6,118,355 | A * | 9/2000 | Pelz | H01P 1/2135 333/134 |
| 7,598,824 | B2 * | 10/2009 | Callewaert | H01P 1/2135 333/126 |
| 10,128,552 | B2 | 11/2018 | Morita et al. | |
| 2005/0012676 | A1 * | 1/2005 | McCarthy | H01P 5/12 343/853 |

FOREIGN PATENT DOCUMENTS

| | | | | |
|---|---|---|---|---|
| JP | 2016015740 | A | 1/2016 | |
| WO | WO-2019128219 | A1 * | 7/2019 | H01P 1/18 |

* cited by examiner

*Primary Examiner* — Robert J Pascal
*Assistant Examiner* — Kimberly E Glenn
(74) *Attorney, Agent, or Firm* — Carter, DeLuca & Farrell LLP

(57) ABSTRACT

There is provided a branch circuit that comprises a first conductor and a second conductor as at least two branches from a predetermined branch point, a first stub connected to the first conductor at a first point, and a second stub connected to the second conductor at a second point, wherein the first point is a point where a length of a portion between the predetermined branch point and the first point of the first conductor is set to a first length determined in accordance with a characteristic of the first stub, and the second point is a point where a length of a portion between the predetermined branch point and the second point of the second conductor is set to a second length determined in accordance with a characteristic of the second stub and is different from the first length.

13 Claims, 32 Drawing Sheets

BRANCH CIRCUIT

BACKGROUND OF THE INVENTION

Field of the Invention

The present invention relates to a branch circuit that transmits a different electromagnetic wave frequency for each branch.

Description of the Related Art

In a wireless communication apparatus, there is a case in which a single antenna will be used in common to perform wireless communication using a plurality of frequency bands. In this case, a transmission line connected to the antenna is branched, and the branched lines are connected to a first transmission/reception circuit unit for wireless communication in a first frequency band and a second transmission/reception circuit unit for wireless communication in a second frequency band, respectively. In this arrangement, if an electromagnetic wave that has been output from one transmission/reception circuit unit flows into another transmission/reception circuit unit, it can interfere with the wireless communication performed by the other transmission/reception circuit unit or destroy the other circuit. In contrast, it is possible to apply, in each of the plurality of paths, a branch circuit such as a diplexer or the like that allows a signal of a desired frequency band to pass and prevents (reflects or attenuates) the passage of a wireless communication transmission wave belonging to different frequency band. In order to implement such characteristics, Japanese Patent Laid-Open No. 2016-15740 discloses a method of arranging a filter element that allows a signal of a desired frequency band to be passed in each transmission line.

In general, there is a need for an electronic device to be downsized, thereby requiring also the downsizing of the electronic circuit substrate of the electronic device. In addition, in order to downsize the electronic circuit substrate, downsizing of components to be mounted on the substrate, the circuit pattern, and the like becomes required. Furthermore, it is important to prevent the cost from increasing along with the downsizing of the electronic device. In this point, an arrangement, such as that disclosed in Japanese Patent Laid-Open No. 2016-15740, in which a component such as a chip filter is added onto a branched line is problematic in that this arrangement will easily increase the cost although it can downsize the circuit by downsizing the components themselves.

SUMMARY OF THE INVENTION

The present invention provides, at a low cost, a small branch circuit that has a different characteristic for each branch.

One aspect of the present invention provides a branch circuit comprising: a first conductor and a second conductor as at least two branches from a predetermined branch point; a first stub which is connected to the first conductor at a first point; and a second stub which is connected to the second conductor at a second point, wherein the first point is a point where a length of a portion between the predetermined branch point and the first point of the first conductor is set to a first length which is determined in accordance with a characteristic of the first stub, and the second point is a point where a length of a portion between the predetermined branch point and the second point of the second conductor is set to a second length which is determined in accordance with a characteristic of the second stub and is different from the first length.

Further features of the present invention will become apparent from the following description of exemplary embodiments (with reference to the attached drawings).

DESCRIPTION OF THE EMBODIMENTS

Figure 1A:
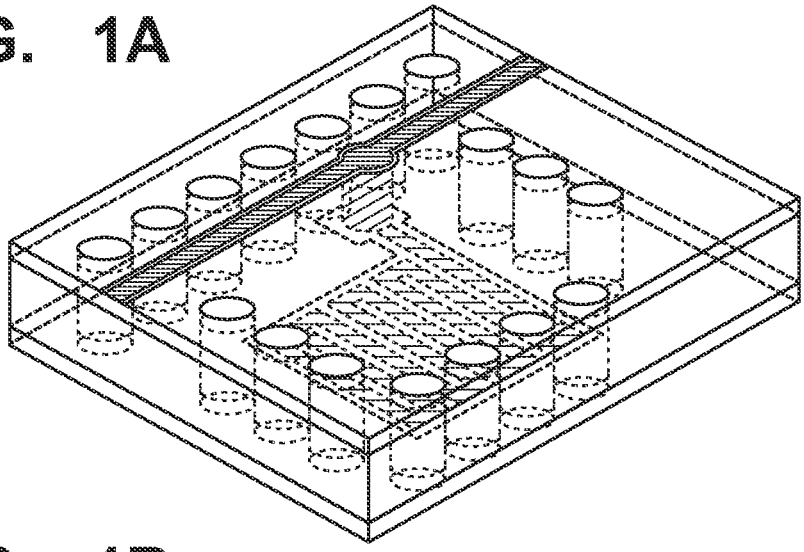
FIGS. 1A and 1B are views showing examples of the first arrangement of a band stop filter.

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

Generally, in a case in which a single antenna is to be used in common to perform wireless communication using a plurality of frequency bands in a wireless communication apparatus, a transmission line to be connected to the antenna will be branched. The branched transmission lines are connected to a transmission/reception circuit unit (first transmission/reception circuit unit) of a wireless communication function which is to use a first frequency band of a wireless IC that controls the wireless communication function and a transmission/reception circuit unit (second transmission/reception circuit unit) of a wireless communication function which is to use a second frequency band of the wireless IC, respectively. An electromagnetic wave output from each transmission/reception circuit unit and an electromagnetic wave received by the antenna are propagated through these transmission lines. Note that an electromagnetic wave includes signals and noise.

As described above, in such a branch circuit, it is important to prevent an electromagnetic wave that has a predetermined frequency component and has been output from one of the two or more transmission/reception circuit units from being input to another transmission/reception circuit unit without attenuation. That is, such a branch circuit requires a function, such as a so-called diplexer, to divide the electromagnetic wave according to each frequency. In this embodiment, in order to implement such a function, a conductor pattern, formed as conductive foil wiring on a substrate, is connected to each of the at least two transmission lines that have branched from a predetermined branch point in the branch circuit. This conductor pattern is formed so that it will function as a band stop filter that attenuates the electromagnetic waves of a plurality of specific frequencies. This can lower the cost compared to a case in which chip components are used. In addition, although a defect caused by mounting can be generated in a case in which chip components are to be mounted onto a substrate, such a defect is hardly generated in a circuit that implements the function of a diplexer by using a conductor pattern. Furthermore, by implementing the function of a diplexer by a conductor pattern instead of mounting chip components, it is possible to reduce, depending on the case, the loss of signals (electromagnetic waves) that propagate in the transmission line.

After a conductor pattern that is to function as the band stop filter is described, the arrangement of a branch circuit using this band stop filter will be described hereinafter. Assume that a coplanar line on a conductor substrate (to be referred as a "coplanar line" hereinafter) will be used in the band stop filter and the branch circuit using this band stop filter to be described hereinafter, and that each filter and each transmission line will be mounted on a general electronic circuit substrate formed from a plurality of layers. Note that a coplanar line is formed by a center conductor and each ground conductor which is arranged a predetermined distance apart from the center conductor. However, among these conductors, the center conductor will be referred to as a "signal line" hereinafter. Note that a line other than the coplanar line may be used as the transmission line. For example, a microstrip line, a strip line, a slot line, a coplanar strip line, a suspended microstrip line, an inverted microstrip line, and the like may be used.

(Filter Arrangement)

Some arrangement examples of the band stop filter to be used in the branch circuit will be described first.

First Arrangement Example

Figure 1B:
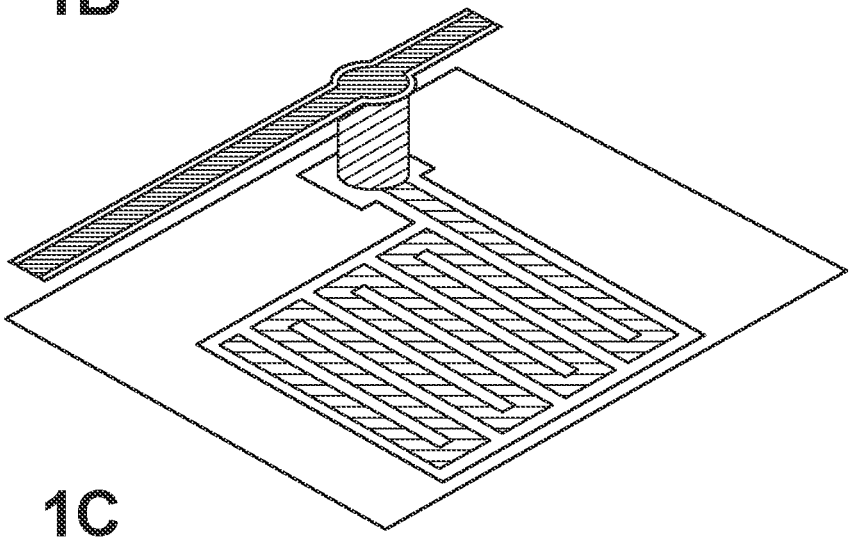

An example of the band stop filter will be described with reference to FIGS. 1A to 1C. FIG. 1A is an example of the arrangement of a band stop filter, and FIG. 1B is a view showing a state in which only the main portion of the band stop filter has been taken to further promote the understanding of the structure of FIG. 1A. As shown by FIGS. 1A and 1B, the band stop filter is implemented by connecting a conductor via to a signal line of a coplanar line and forming a meander-shaped conductor connected to the via in a layer below a layer where the signal line is to be arranged.

Here, for example, in this arrangement, a signal line (transmission line) is arranged in the first layer of a four-layer structure, and a meander-shaped conductor is formed in the third layer, as shown in FIG. 1A. At this time, not only the signal line but also ground conductors may be arranged in the first layer. For example, if the transmission line formed in the first layer is a coplanar line, the signal line and the ground conductor are formed so that the line is held between the ground conductors at a predetermined distance. In addition, not only the meander-shaped conductor but also a ground conductor can be arranged in the third layer. At this time, for example, the meander-shaped conductor and the ground conductor are formed so that the ground conductor is arranged around the meander-shaped conductor at a predetermined distance. Note that for example, planar ground conductors each having a large area can be arranged in the second and fourth layers of the four-layer structure. At this time, these ground conductors are formed so as not to be set in a connected state with, for example, the conductor via which connects the signal line and the meander-shaped conductor shown in FIGS. 1A and 1B. Note that the ground conductors formed in the respective layers can be connected to the (many) conductor vias as shown in FIG. 1A in order to achieve the same ground potential in each and every layer. Note that in each arrangement example, unless otherwise specified, assume that ground conductors are arranged in the respective plurality of layers, and that these layers are connected by corresponding conductor vias even in a case in which these components are not shown in the drawings.

FIG. 1B shows the structure obtained by removing, from the structure of FIG. 1A, the ground conductors in the first, second, and fourth layers and further removing the conductor vias which connect the ground conductors. Note that in FIG. 1B, a planar conductor arranged around the meander-shaped conductor is the ground conductor formed in the third layer. As is obvious from FIGS. 1A and 1B, the meander-shaped conductor is formed so as to be held between (large-area) ground conductors of the respective second and fourth layers and to be surrounded by a ground conductor in the third layer where the meander-shaped conductor is arranged. In the arrangement of FIG. 1A, the ground conductor of the second layer held between the signal line and the meander-shaped conductor is configured to eliminate electromagnetic coupling between the signal line and the meander-shaped conductor.

This meander-shaped conductor is a linear conductor with a uniform line width, and whose one end is connected to the via and whose other end is an open end to which nothing is electrically connected. It is possible, by having a meander shape, to reduce the entire size of the structure so that the structure will be mountable even on a small substrate.

Figure 1C:
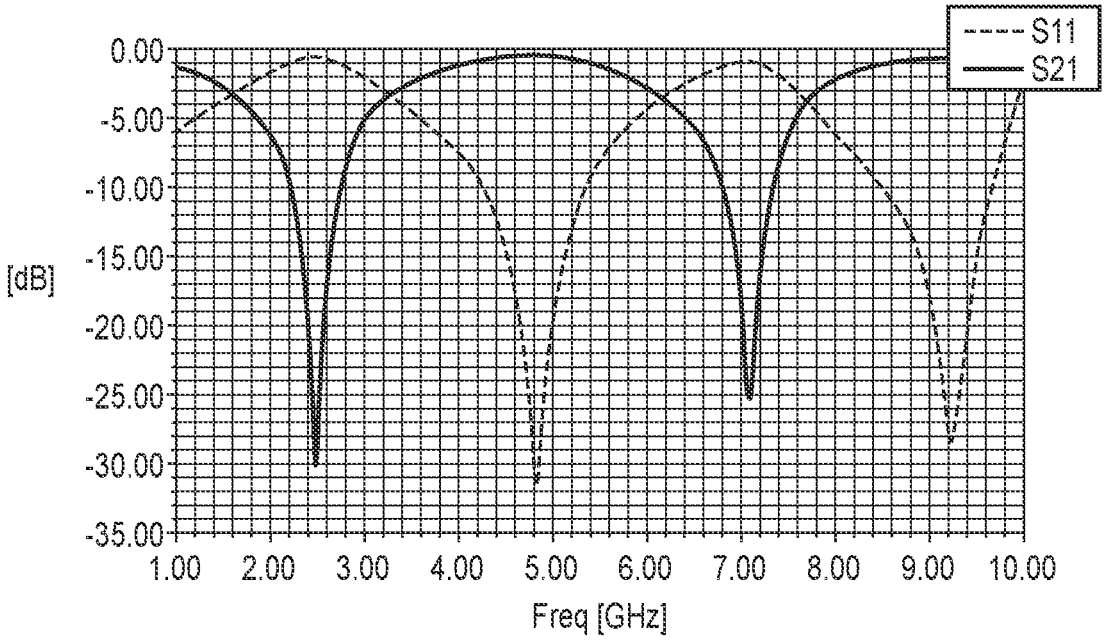
FIG. 1C is a graph showing the characteristics of the band stop filter.

FIG. 1C shows a simulation result of a reflection coefficient S11 and a transmission coefficient S21 at input/output ends (Port1 and Port2) of the coplanar line in which the band stop filter as shown in FIGS. 1A and 1B is mounted. As seen in FIG. 1C, high attenuation is found in the curve of the transmission coefficient S21 at a frequency near 2.45 GHz, and it can be understood that the propagation of an electromagnetic wave near 2.45 GHz is stopped. In addition, high attenuation is also found in the curve of the transmission coefficient S21 near 7.1 GHz which is about triple of 2.45 GHz, and it can be understood that the propagation of an electromagnetic wave near 7.1 GHz is also stopped. This is because the meander-shaped conductor and the via connected to the coplanar line resonate at a specific frequency. A conductor portion (that is, the meander-shaped conductor) connected to the via will be referred to as a stub, and a conductor combining the via and the stub will be referred to as a resonance conductor hereinafter. Note that the vias for connecting the ground conductors with each other are arranged around the stub, as shown in FIG. 1A. This allows the resonance frequency of the resonance conductor to be less susceptible to influences from a substrate shape, a substrate circuit, a component mounted on the substrate, and the like.

In a resonance conductor whose one end is connected to the signal line and whose other end has an open end as described above, resonance occurs in a frequency band of an electrical length λ which is quadruple of the total length of the resonance conductor, thus stopping an electromagnetic wave at that frequency from propagating in a transmission line. That is, in order to stop the propagation of the electromagnetic wave in a certain frequency band with the electrical length λ, the resonance conductor is designed so as to have a total length of λ/4. Similarly, the electromagnetic wave in the frequency band with the electrical length λ can also resonate in a resonance conductor having a total length of 3λ/4 and be stopped. That is, a resonance conductor having a total length of L can stop the propagation of an electromagnetic wave having an electrical length of 4L and an electromagnetic wave having an electrical length of 4L/3. In the structure of FIGS. 1A and 1B, the total length of the resonance conductor is a quarter of the electrical length λ of about 2.45 GHz and three quarters of the electrical length λ of about 7.1 GHz, thereby stopping the propagation of the electromagnetic wave near 2.45 GHz and the electromagnetic wave near 7.1 GHz.

Letting f1 (2.45 GHz in this arrangement example) be a frequency band serving as the first stopband and f2 (7.1 GHz in this arrangement example) be a frequency band serving as the second stopband, the relation of f2≅3×f1 holds when the meander-shaped conductor has a uniform line width as in FIGS. 1A and 1B.

In the structure as shown in FIGS. 1A and 1B described above, it is possible, by adjusting the length of the meander-shaped conductor, to set one of f1 and f2 to be at a desired frequency (a frequency to be set as the stopband). However, the relation between f1 and f2 is f2≅3×f1 as described above. Thus, if the relation between the plurality of frequency bands to be stopped is a relation other than the above-described relation, a plurality of desired frequency bands cannot be stopped with the structure of FIGS. 1A and 1B.

Figure 2A:
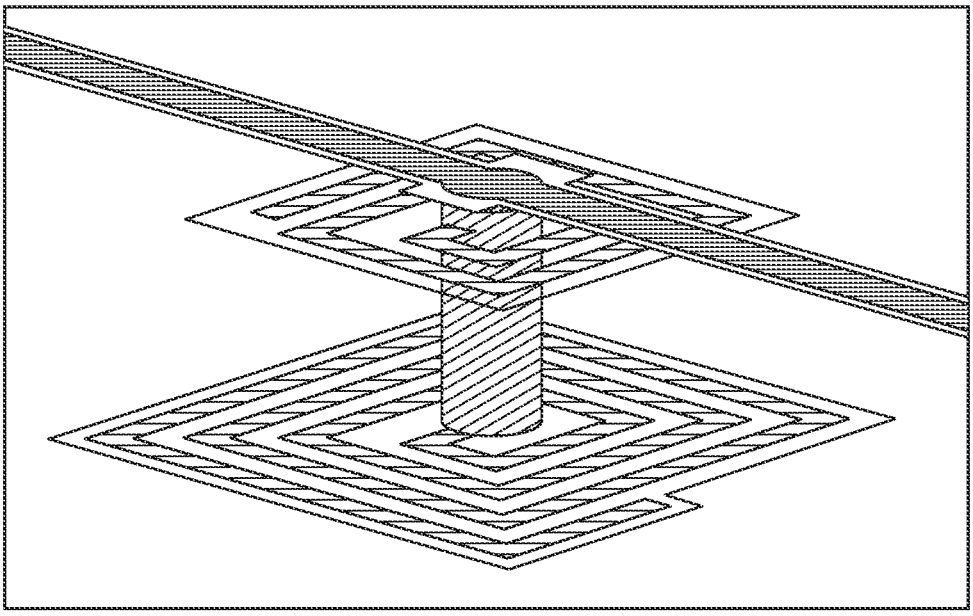
FIGS. 2A and 2B are a view showing an example of the first arrangement of the band stop filter and a graph showing the characteristics of the band stop filter, respectively.
Figure 2B:
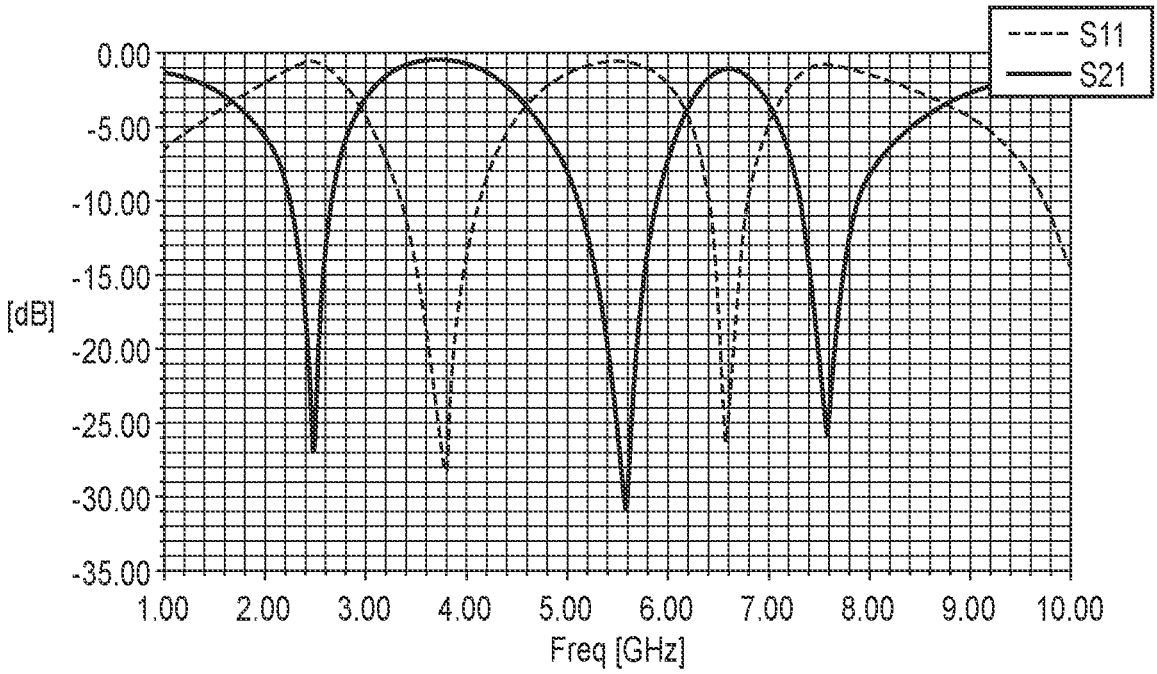

Hence, the arrangement of a band stop filter that stops the propagation of electromagnetic waves in the plurality of desired frequency bands will now be described. FIG. 2A shows an example of the arrangement of a band stop filter that stops the plurality of desired frequency bands. FIG. 2B shows the characteristics of the band stop filter in FIG. 2A. In the band stop filter of FIG. 2A, a via is connected to a signal line of a coplanar line, and a spiral-shaped stub (stub 1) connected to the via is arranged in a layer below a layer where the signal line is arranged. In this band stop filter, a stub (stub 2) connected to the via is also arranged in a layer further under the layer where the stub 1 is arranged. For example, the coplanar line can be formed in the first layer of a four-layer substrate, and the stub 1 and the stub 2 can be formed in the second layer and the third layer or the third layer and the fourth layer, respectively. Note that the stub 1 has a uniform line width, and the stub 2 also has a uniform line width. In the arrangement of FIG. 2A, each length of the stub 1 and the stub 2 is adjusted in accordance with, for example, a frequency band that stops propagation. Note that a 2.45-GHz band and a 5.5-GHz band serve as frequency bands that stop propagation.

FIG. 2B shows a simulation result of the reflection coefficient S11 and the transmission coefficient S21 at the input/output ends (Port1 and Port2) of the coplanar line in which the band stop filter is mounted as shown in FIG. 2A. As is obvious from in FIG. 2B, the stopbands are formed in the 2.45-GHz band and the 5.5-GHz band, respectively, and the stopbands can be formed in the plurality of desired frequency bands by the structure of FIG. 2A.

In general, it is possible, by connecting a plurality of resonance conductors each having a predetermined length to the transmission line, to form the stopbands in the plurality of desired frequency bands. For example, it is possible to form the stopbands in two frequency bands by connecting two resonance conductors to two portions on the transmission line and making the total length of each resonance conductor be a quarter of the electrical length λ of a corresponding one of frequencies. In general, however, a loss will occur in a signal which propagates onto the transmission line if a discontinuous part such as a via is present in the transmission line. If a plurality of connecting portions exist on the signal line, a plurality of discontinuous parts may exist on the transmission line, thus greatly degrading the transmission characteristic of the transmission line. That is, in addition to stopping an undesired electromagnetic wave, it also can degrade the signal quality of an electromagnetic wave in a frequency band to be transmitted (to be passed through). Further, if an arrangement includes a plurality of filter structures, it becomes difficult to downsize the electronic circuit.

To cope with this, FIG. 2A adopts a structure in which a plurality of stubs branch off from one via connected to the signal line so as to minimize the number of connection points to the signal line of a resonance conductor connected to the signal line. This makes it possible to suppress the degradation in signal quality because the discontinuous parts of the signal line are decreased. Further, as in FIG. 2A, the respective stubs are arranged so as to overlap each other when viewed from a direction perpendicular to a substrate plane, allowing the filter to have a smaller mounting area and be mounted on a small substrate. Furthermore, it is also possible to reduce the size of the filter by sharing the via. As described above, it is possible, by connecting the plurality of stubs to one via connected to the signal line, to form a small filter which forms the stopbands in the plurality of desired frequency bands while suppressing the degradation in signal quality.

Second Arrangement Example

The first arrangement example showed an arrangement in which a plurality of stubs, each having a length corresponding to the frequency band of a corresponding one of stopbands in order to obtain a plurality of desired stopbands, are connected to the via which is connected to the signal line. In contrast, in the second arrangement, a filter arrangement that can implement a plurality of desired stopbands in a state in which a stub which is connected to a via is arranged in one layer will be described.

As has been described in the first arrangement example, letting f1 be the frequency band serving as the first stopband and f2 be the frequency band serving as the second stopband when the meander-shaped stub in FIG. 1A has a uniform line width, the relation of f2≅3×f1 holds, and the stopbands can be set only under this relation. In contrast, in this embodiment, a filter arrangement will be described in which a first stopband f1 and a second stopband f2 can be set arbitrarily while being formed in one layer by adjusting the line width of the stub connected to the via.

Each of FIGS. 3A to 3J shows an example of the arrangement of a band stop filter according to this arrangement example. FIGS. 3A to 3E are views each showing the arrangement of the filter. Each of FIGS. 3F to 3J shows a simulation result of the reflection coefficient S11 and the transmission coefficient S21 at input/output ends (Port1 and Port2) of a coplanar line in which the band stop filter in FIGS. 3A to 3E is mounted.

In the band stop filter of each of FIGS. 3A to 3E, a via is connected to the signal line of the coplanar line, and a meander-shaped stub connected to the via is arranged in a layer below a layer where the signal line is arranged. In each band stop filter shown in FIGS. 3A to 3E, the stub has two or more different line widths and is arranged so that the line width of the portion of the stub which includes the open end is larger than that of the portion of the stub which includes the via-connection portion. The length ratio between the different line width portions of the stub is different in each of FIGS. 3A to 3E. Accordingly, each of FIGS. 3F to 3J shows a characteristic change when such a ratio changes.

As is apparent from FIGS. 3F to 3J, it is found that the first stopband (the stopband on the low frequency side) is not changed greatly, but the second stopband (the stopband on the high frequency side) is changed by changing the length ratio between a portion having a large stub line width and a portion having a small stub line width. That is, as seen in FIGS. 3F to 3J, while the frequency band f1 serving as the first stopband is about 2.2 GHz in either case, the frequency band f2 serving as the second stopband changes between 6.9 GHz and 7.4 GHz. That is, it is found that f2>3×f1 can be obtained by making an open end of the stub have a larger line width than the portion other than the open end.

Figure 3A:
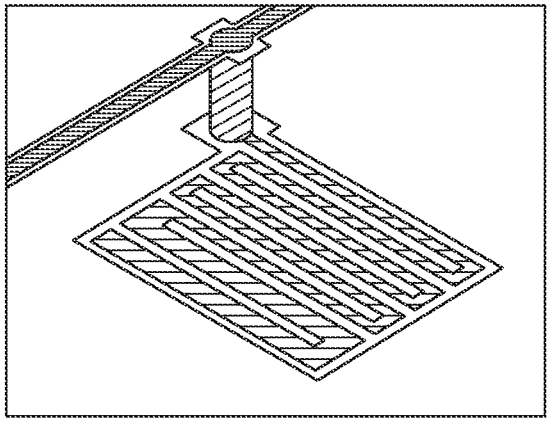
FIGS. 3A to 3E are views showing examples of the second arrangement of the band stop filter.
Figure 3D:
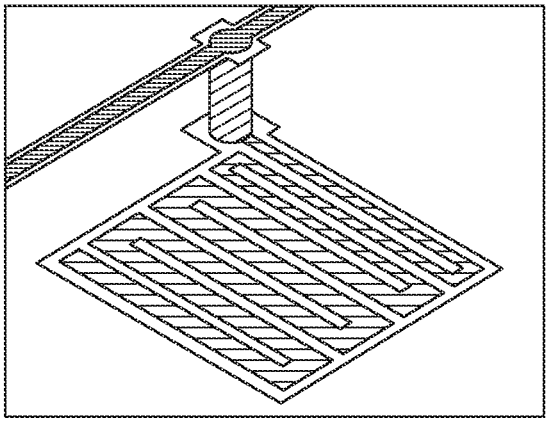
Figure 3B:
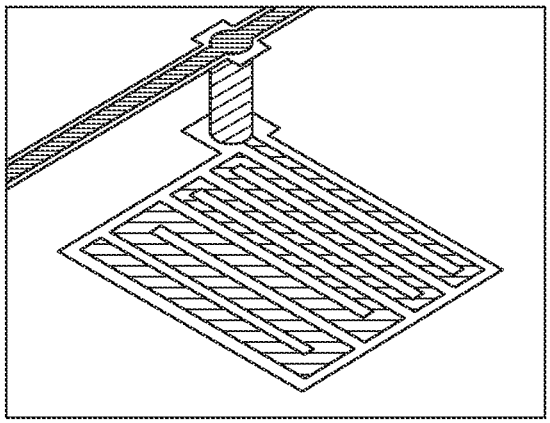
Figure 3E:
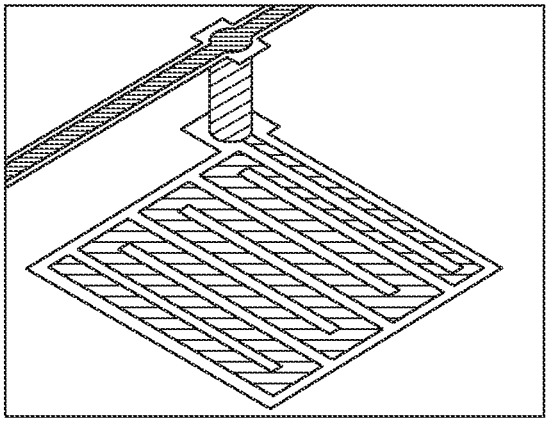
Figure 3C:
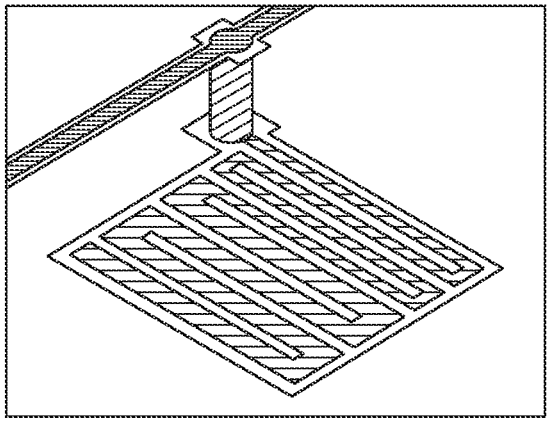
Figure 3F:
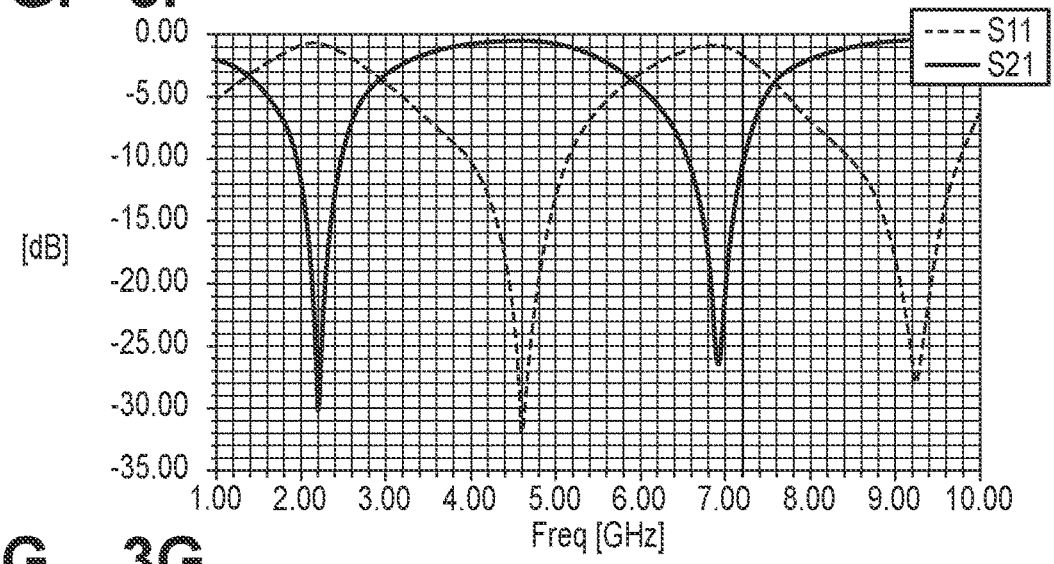
FIGS. 3F to 3J are graphs showing the characteristics of the band stop filter.
Figure 3G:
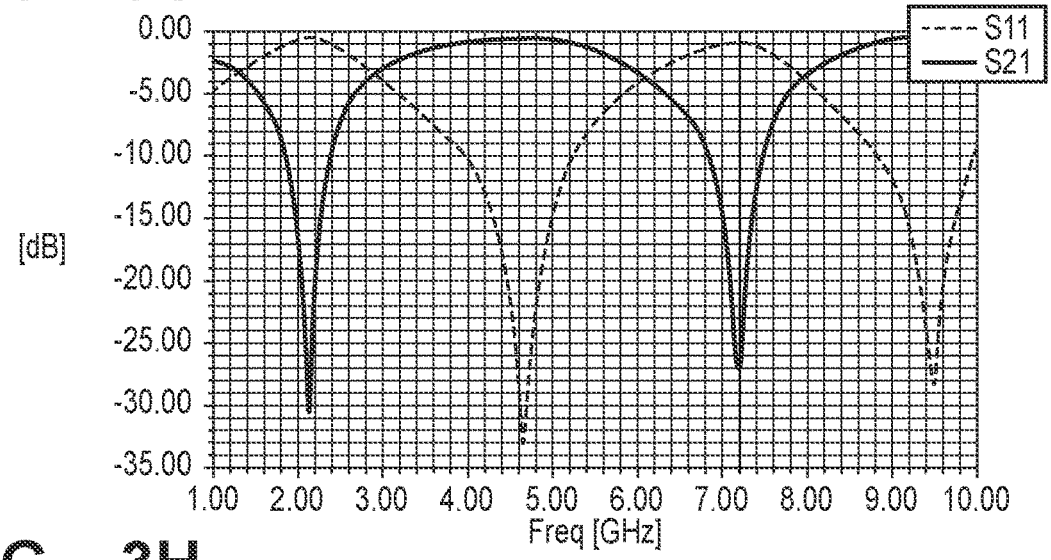
Figure 3H:
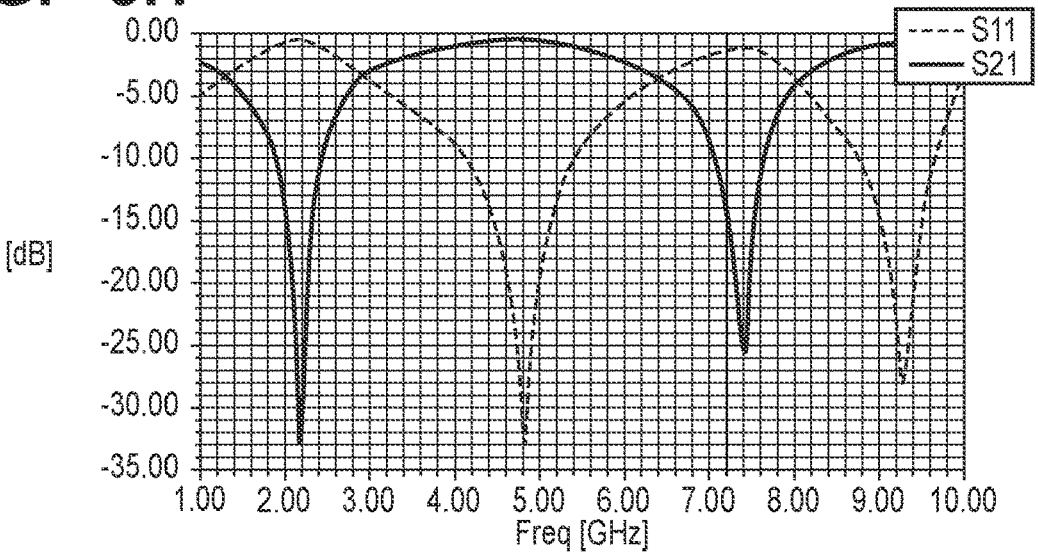
Figure 3I:
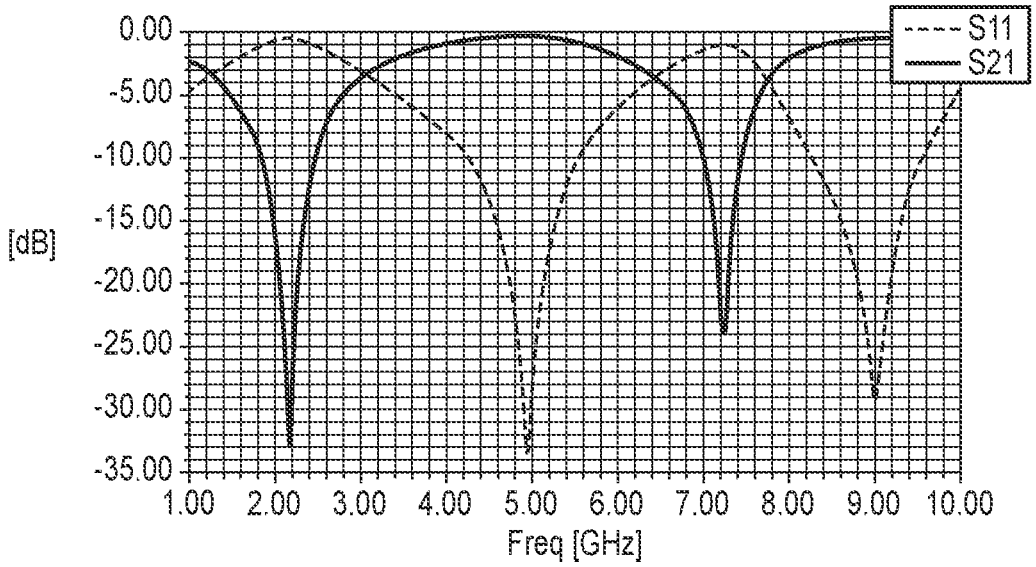
Figure 3J:
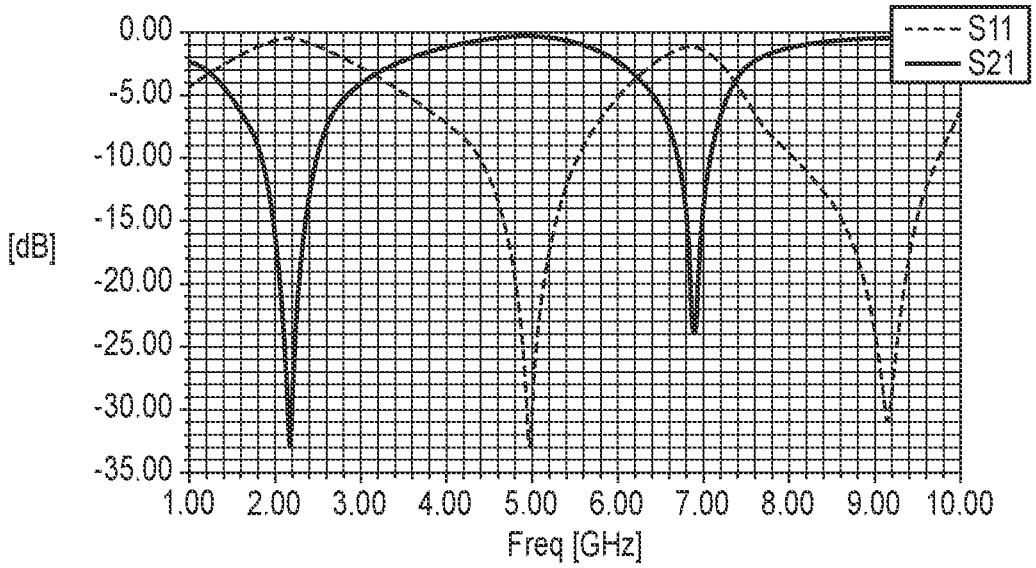

If the length ratio between the portion having the large stub line width and the portion having the small stub line width is almost equal as shown in FIG. 3C, the second stopband (the stopband on the high frequency side) is 7.4 GHz as shown in FIG. 3H. As compared with FIGS. 3F, 3G, 3I, and 3J, it is found that FIG. 3H includes the second stopband in the high frequency band f2 farthest from a stopband in the low frequency band f1. It is also found that the characteristics in FIGS. 3F and 3J are almost the same, and the characteristics in FIGS. 3G and 3I are almost the same. Therefore, it becomes possible, by adjusting the length ratio between the portion having the large stub line width and the portion having the small stub line width, to adjust the frequency band f1 serving as the first stopband and the frequency band f2 serving as the second stopband to be desired frequency bands in the range of f2>3×f1.

Figure 4A:
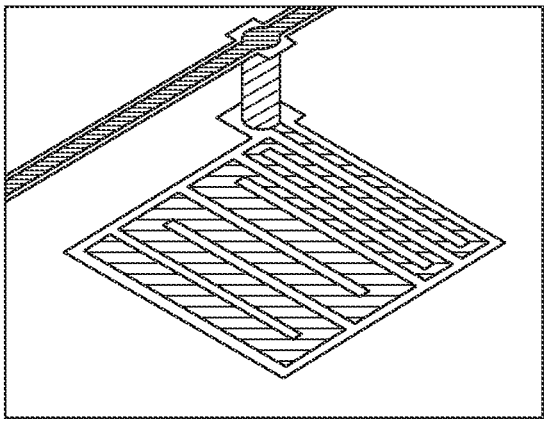
FIGS. 4A to 4C are views showing examples of the second arrangement of the band stop filter.
Figure 4B:
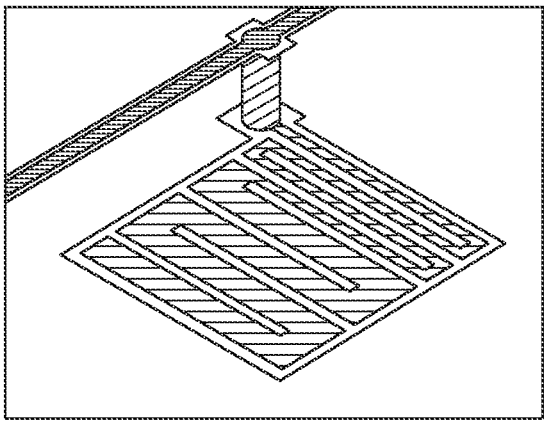
Figure 4C:
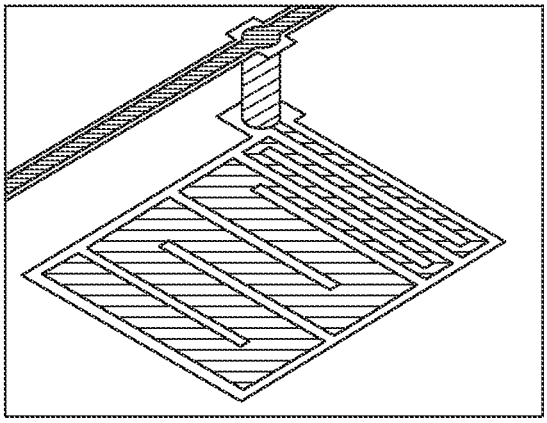
Figure 4D:
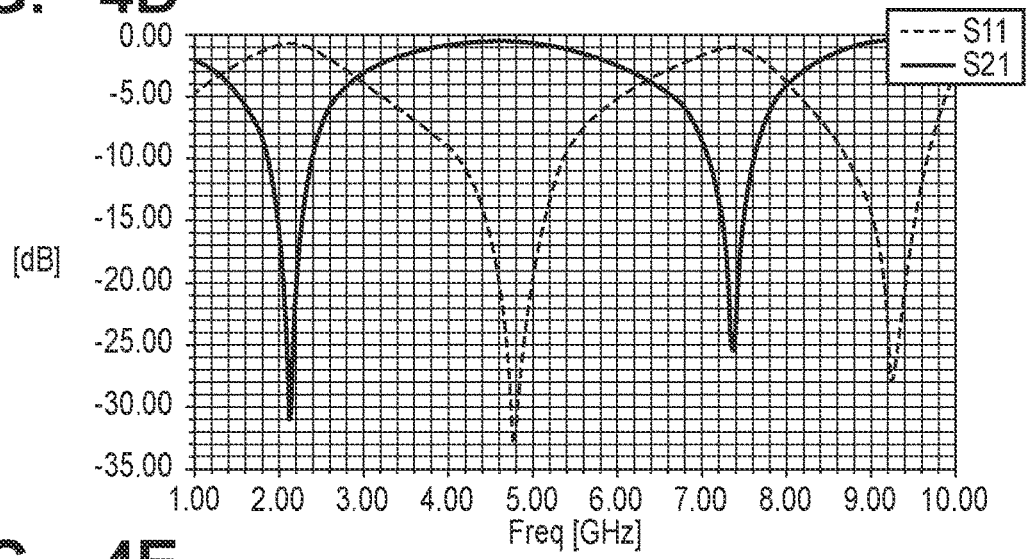
FIGS. 4D to 4F are graphs showing the characteristics of the band stop filter.
Figure 4E:
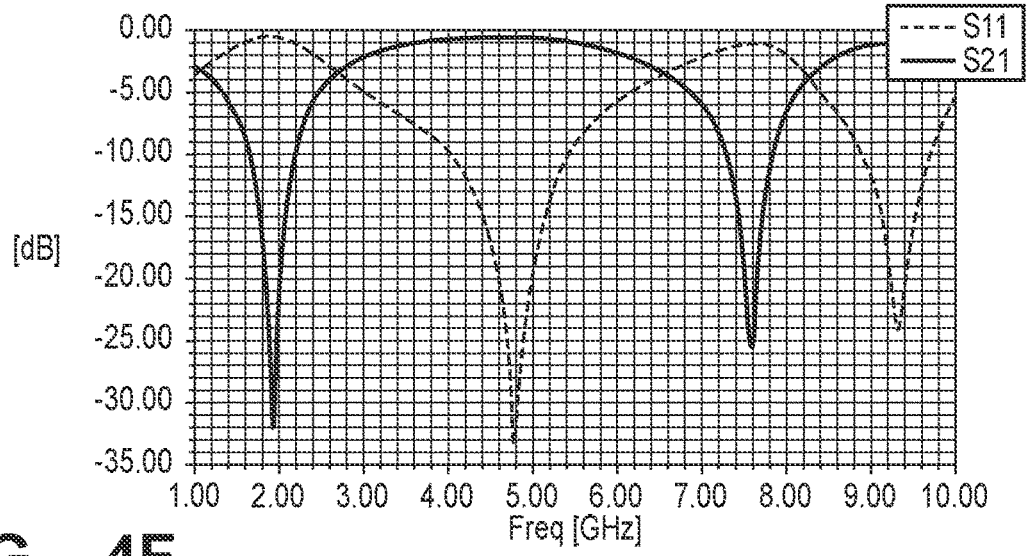
Figure 4F:
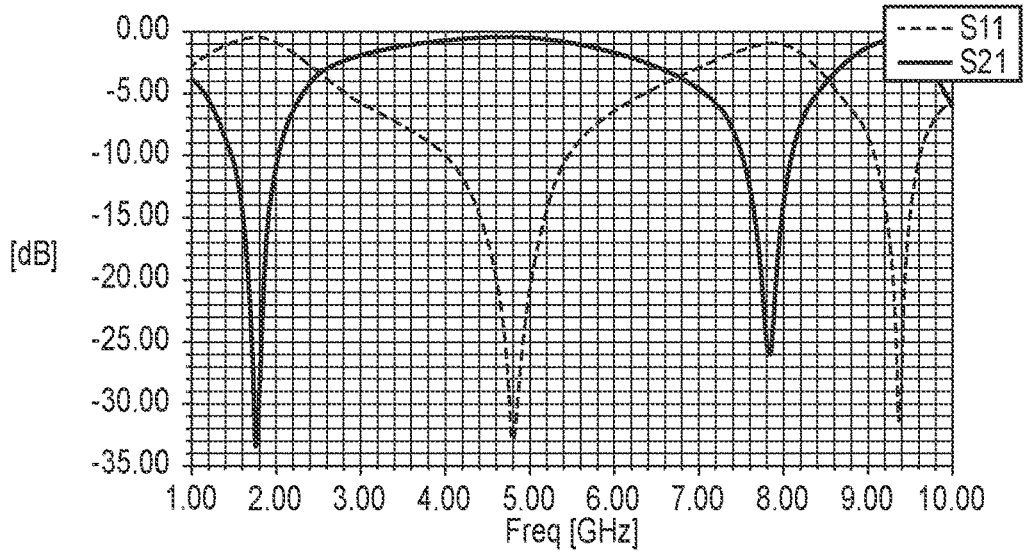

Next, each of FIGS. 4A and 4F shows a filter structure and its characteristic when the portion having the large stub line width and the portion having the small stub line width are generally made equal to each other in length, and a line width is changed. FIG. 4A shows an arrangement in which the line-width ratio between a thin portion and a thick portion is the closest to 1, FIG. 4C shows the arrangement in which the ratio is the farthest from 1, and FIG. 4B is the arrangement in which the ratio lies between those of FIGS. 4A and 4C. Note that FIGS. 4D to 4F show characteristics in FIGS. 4A to 4C, respectively. As seen in FIGS. 4D to 4F, as the line-width ratio is away from 1, f2 is away from f1, and a stopband shifts to a higher frequency band.

As described above, in the band stop filter as shown in FIGS. 1A and 1B, it is possible, by making the line width of the open end of the stub larger than the line width of the portion other than that, to set the relation between the frequency band f1 serving as the first stopband and the frequency band f2 serving as the second stopband to f2>3×f1. It is also possible, by adjusting the line-width ratio and the length ratio between the portion having the large stub line width and the portion having the small stub line width, to adjust the frequency bands f1 and f2 of the stopbands. Note that the characteristics of the band stop filter structures in FIGS. 3A and 3E are almost the same and further, the characteristics of the band stop filter structures in FIGS. 3B and 3D are almost the same, as described above. Here, as the filter can be downsized by decreasing the line width of a conductor in a structure, it is possible to further downsize the band stop filter of FIG. 3A than that of FIG. 3E since FIG. 3A has a higher ratio of a small line width. Similarly, it is possible to further downsize the band stop filter of FIG. 3B than that of FIG. 3D since FIG. 3B has a higher ratio of a small line width. That is, by setting the length of the portion having the large stub line width and the length of the portion having the small stub line width to have a relation in which the length of the portion having the large stub line width the length of the portion having the small stub line width, it becomes possible to downsize the filter structure.

As described above, it is possible, by increasing the line width of the open end of the stub, to set the relation between the frequency band f1 serving as the first stopband and the frequency band f2 serving as the second stopband to f2>3×f1. It is also possible, by adjusting the line-width ratio and the ratio between the length of the portion having the large stub line width and the length of the portion having the small stub line width, to set a desired frequency band to a stopband. At this time, it is also possible to downsize the filter structure by making the length of the portion having the large stub line width shorter than the length of the portion having the small stub line width.

In this arrangement example, in order to form a band stop filter that stops the plurality of frequency bands, the band stop filter that stops the plurality of frequency bands is formed not by connecting a plurality of resonance elements to a transmission line separately but by using a stub connected to the transmission line by one via. This makes it possible to reduce the loss of a signal propagating through the signal line in the same manner as the first arrangement example. Further, since this arrangement example does not require a plurality of resonance elements to be arranged, it becomes possible to downsize the electronic circuit that includes the band stop filter.

Third Arrangement Example

This arrangement example will describe, in the same manner as the second arrangement example, a filter arrangement in which a plurality of desired stopbands are obtained while a stub which is connected to a via is arranged in one layer. Unlike the second arrangement example, in this arrangement example, it is possible to set the relation between a frequency band f1 serving as the first stopband and a frequency band f2 serving as the second stopband to f2<3×f1 by decreasing the line width of the open end of the stub.

Figure 5A:
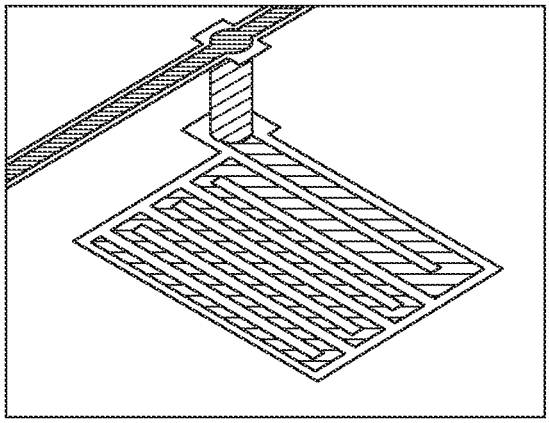
FIGS. 5A to 5E are views showing examples of the third arrangement of the band stop filter.
Figure 5D:
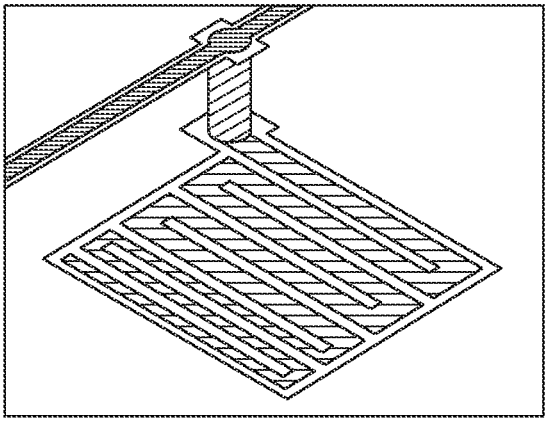
Figure 5B:
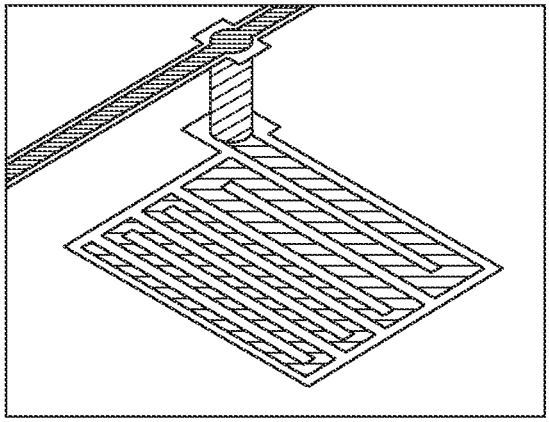
Figure 5E:
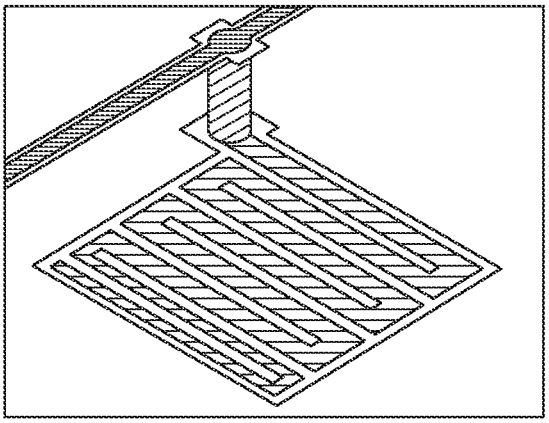
Figure 5C:
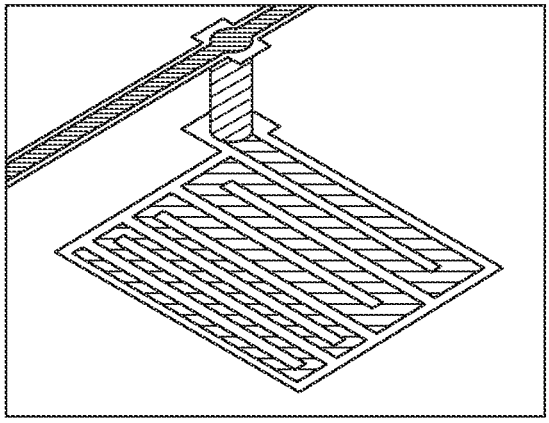
Figure 5F:
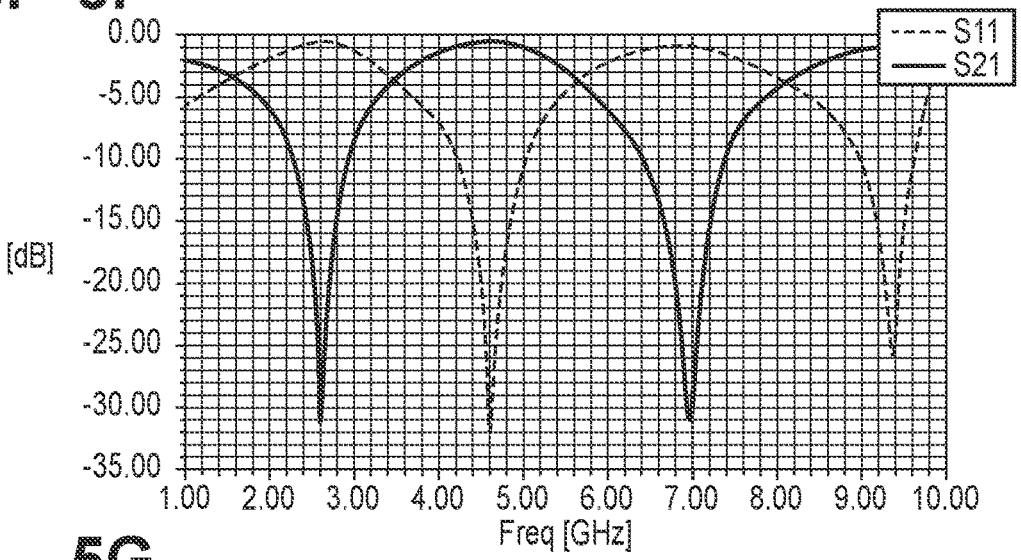
FIGS. 5F to 5J are graphs showing the characteristics of the band stop filter.
Figure 5G:
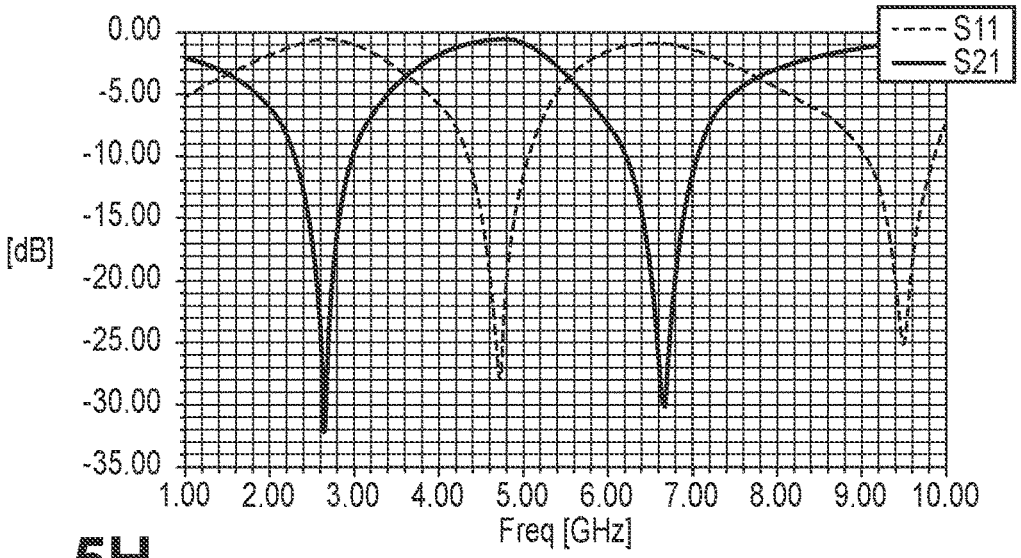
Figure 5H:
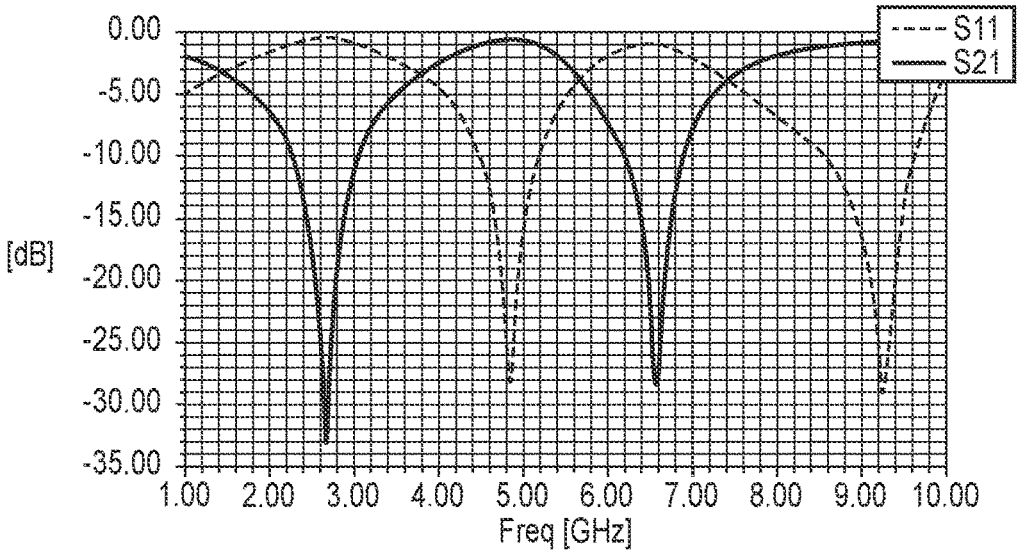
Figure 5I:
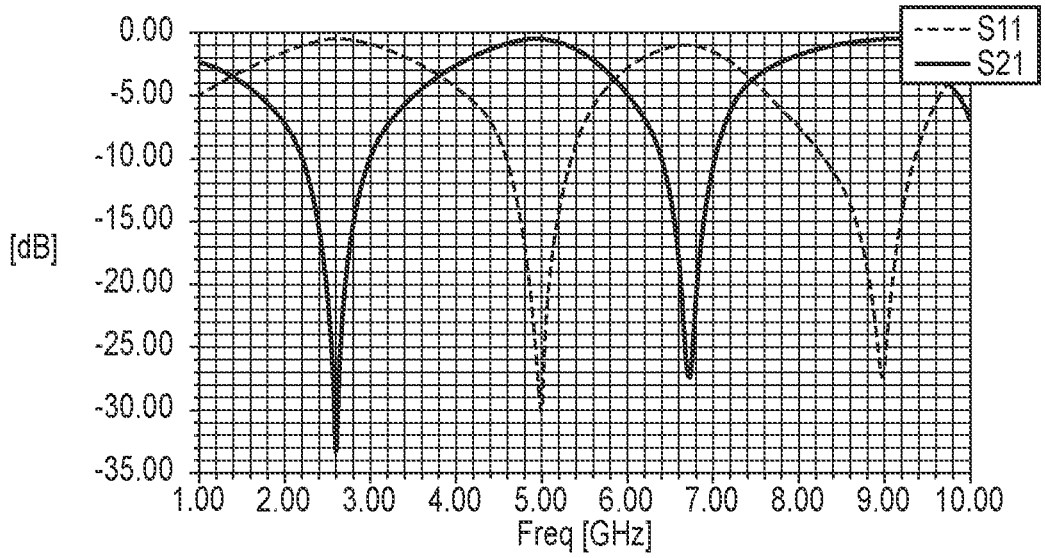
Figure 5J:
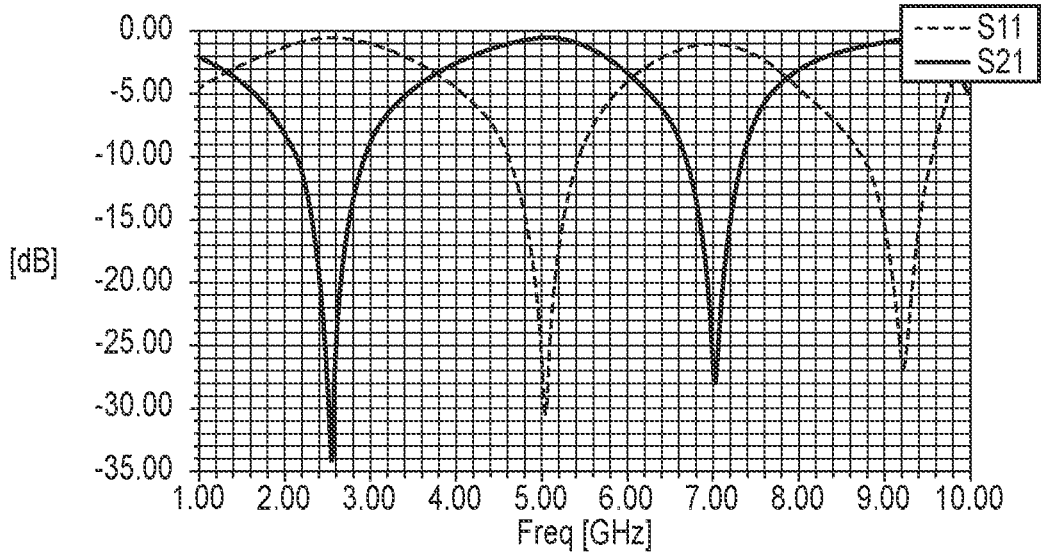

Each of FIGS. 5A to 5E shows a filter structure when the length ratio between the portions of the stub with different line widths is changed. FIGS. 5F to 5J show the respective characteristics of their filter structures. From FIGS. 5F to 5J, the first stopband (a stopband on the low frequency side) is about 2.6 GHz and is not changed greatly, but the second stopband (a stopband on the high frequency side) is changed when the length ratio between a portion having a large stub line width and a portion having a small stub line width is changed as in FIGS. 5A to 5E. If the length ratio between the portion having the large stub line width and the portion having the small stub line width is almost equal as shown in FIG. 5C, the second stopband (the stopband on the high frequency side) is about 6.6 GHz. As compared with the filter structures of FIGS. 5A, 5B, 5D, and 5E, this filter structure of FIG. 5C includes the stopband of the low frequency band f2 closest to the frequency band f1 of the stopband on the low frequency side. The characteristics in FIGS. 5F and 5J are almost the same, and the characteristics in FIGS. 5G and 5I are almost the same. In any of the cases of FIGS. 5F to 5J, the relation between the frequency band f1 serving as the first stopband and the frequency band f2 serving as the second stopband is f2<3×f1.

Figure 6A:
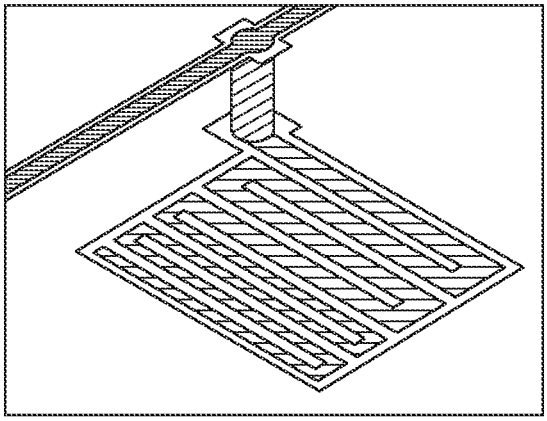
FIGS. 6A to 6C are views showing examples of the third arrangement of the band stop filter.
Figure 6B:
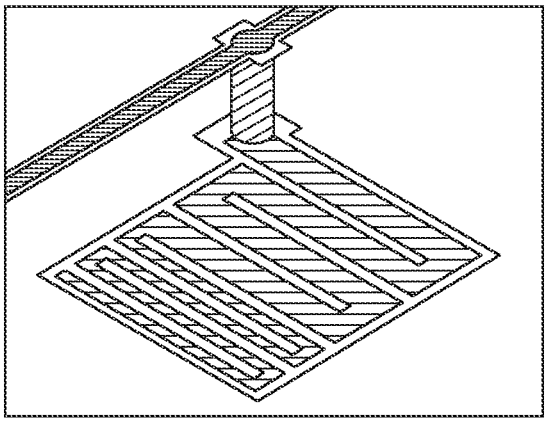
Figure 6C:
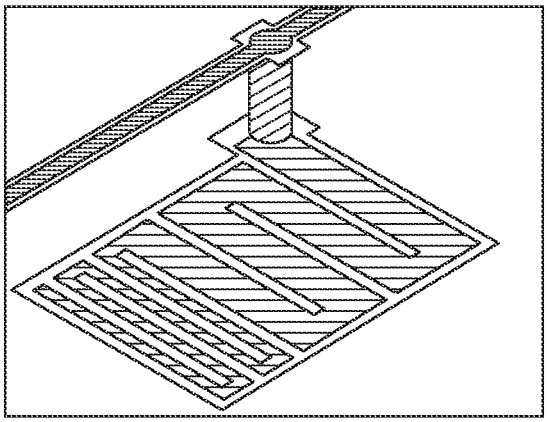
Figure 6D:
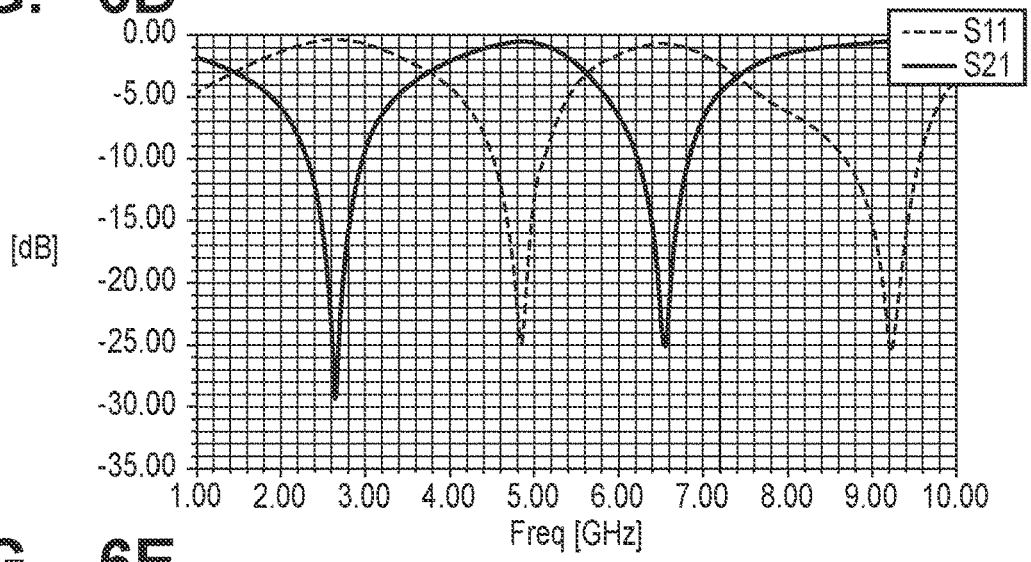
FIGS. 6D to 6F are graphs showing the characteristics of the band stop filter.
Figure 6E:
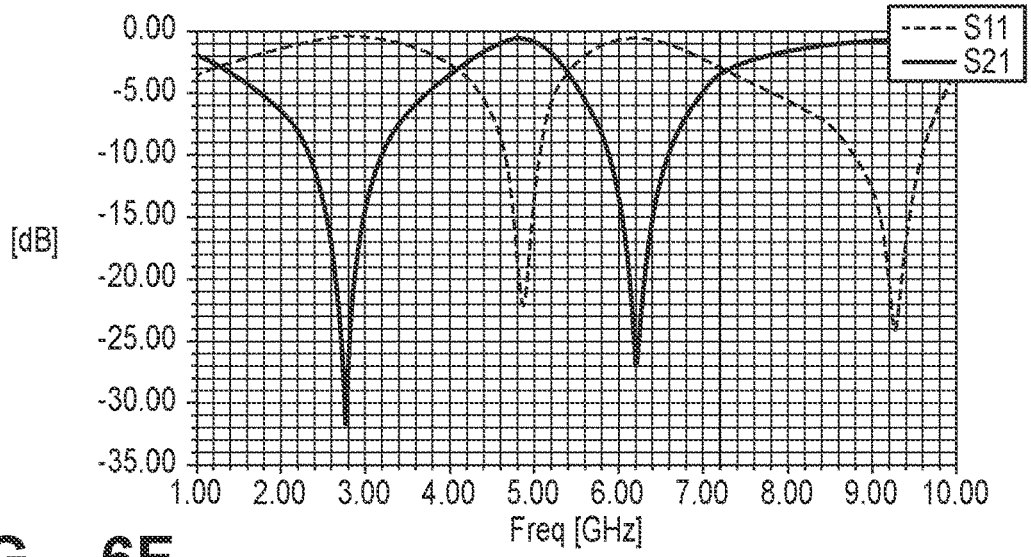
Figure 6F:
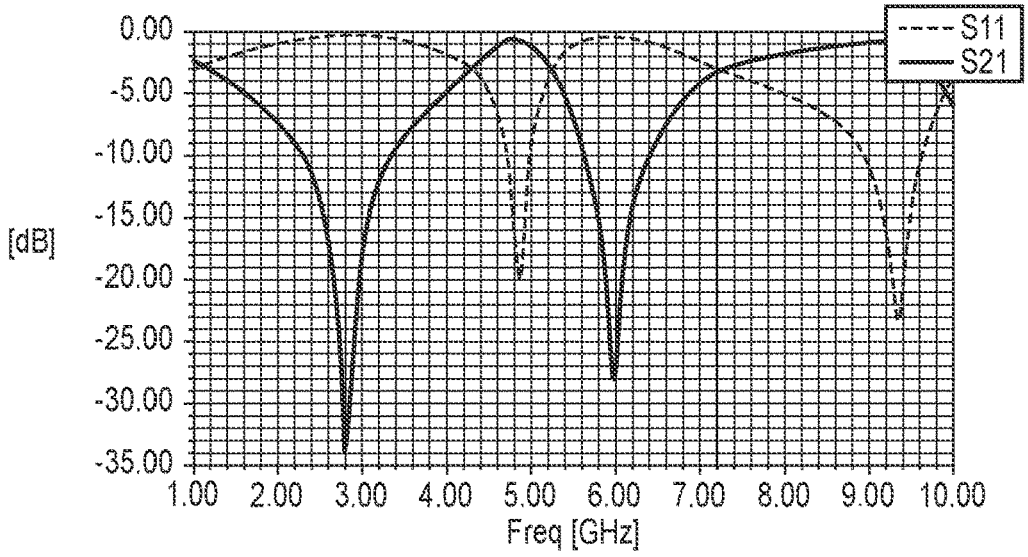

Each of FIGS. 6A to 6C shows a filter structure with different line widths and in which the length of a portion having a large stub line width and the length a portion having a small stub line width are generally equal to each other. FIGS. 6D to 6F show the characteristics of their filter structures. As seen in FIGS. 6D to 6F, the farther apart the line-width ratio is from 1 (the difference between the line width of a thick portion and the line width of a thin portion is large), the higher frequency band f2 of the stopbands becomes closer to the lower frequency band f1 and shifts to the lower frequency side.

As described above, it is possible, by making the line width of the open end of the stub smaller than the line width of a portion other than that in the band stop filter as show in FIGS. 1A and 1B, to set the relation between the frequency band f1 serving as the first stopband and the frequency band f2 serving as the second stopband to f2<3×f1. It is also possible, by adjusting the line-width ratio and the length of the portion having the large stub line width and the length of the portion having the small stub line width, to set a desired frequency band to a stopband. Note that as described above, the characteristics in FIGS. 5F and 5J are almost the same, and the characteristics in FIGS. 5G and 5I are almost the same. Accordingly, it is possible to downsize the filter structure by making the length of the portion having the large stub line width shorter than the length of the portion having the small stub line width. Hence, it is possible to further downsize the band stop filter of FIG. 5A than that of FIG. 5E since FIG. 5A has a higher ratio of a small line width. Similarly, it is possible to further downsize the band stop filter of FIG. 5B than that of FIG. 5D since FIG. 5B has a higher ratio of a small line width. That is, by setting the lengths of the portion having the large stub line width and the portion having the small stub line width to have a relation in which the length of the portion having the large stub line width the length of the portion having the small stub line width, it becomes possible to downsize the filter structure.

As described above, by decreasing the line width of the portion of the stub which includes the open end, it is possible to set the relation between the frequency band f1 serving as the first stopband and the frequency band f2 serving as the second stopband to f2<3×f1. It is also possible to set a desired frequency band as a stopband by adjusting the ratio between the line-width ratio and the length of the portion having the large stub line width and the length of the portion having the small stub line width. At this time, it is also possible to downsize the filter structure by making the length of the portion having the large stub line width shorter than the length of the portion having the small stub line width.

As is obvious from FIGS. 4A to 4F according to the second arrangement example and FIGS. 6A to 6F according to this arrangement example, the larger an area occupied by the stub line width is, the larger the attenuation is in the transmission coefficient S21. That is, FIG. 4C of FIGS. 4A to 4C and FIG. 6C of FIGS. 6A to 6C obtain the largest attenuation with respect to the transmission coefficient S21. Therefore, it becomes possible to form a filter having a desired characteristic by determining the stub line width at the time of design so as to obtain a desired transmission characteristic (attenuation characteristic).

In this arrangement example, in the same manner as the first and second arrangement examples, in order to form a band stop filter that stops the plurality of frequency bands, the band stop filter that stops the plurality of frequency bands is formed by using a stub connected to the transmission line by one via. This makes it possible to reduce the loss of a signal propagating through the signal line in the same manner as the first and second arrangement examples. Further, since this arrangement example does not require a plurality of resonance elements to be arranged as well, it becomes possible to downsize the electronic circuit that includes the band stop filter. Furthermore, in the same manner as the second arrangement example, the band stop filter of this arrangement example is configured to arrange one stub in one layer, and thus is also applicable to, for example, a substrate which has fewer layers such as a two-layer substrate.

Fourth Arrangement Example

In each filter structure of the first to third arrangement examples, the ground conductor is arranged around the stub in the layer where the stub is arranged. Further, in each filter structure of the first to third arrangement examples, the ground conductors are also arranged in the upper and lower layers, respectively, facing the layer where the stub is arranged, and the stub is arranged to be held between the ground conductors. That is, in each filter structure of the first to third arrangement examples, the ground conductor is arranged around the stub.

Figure 8:
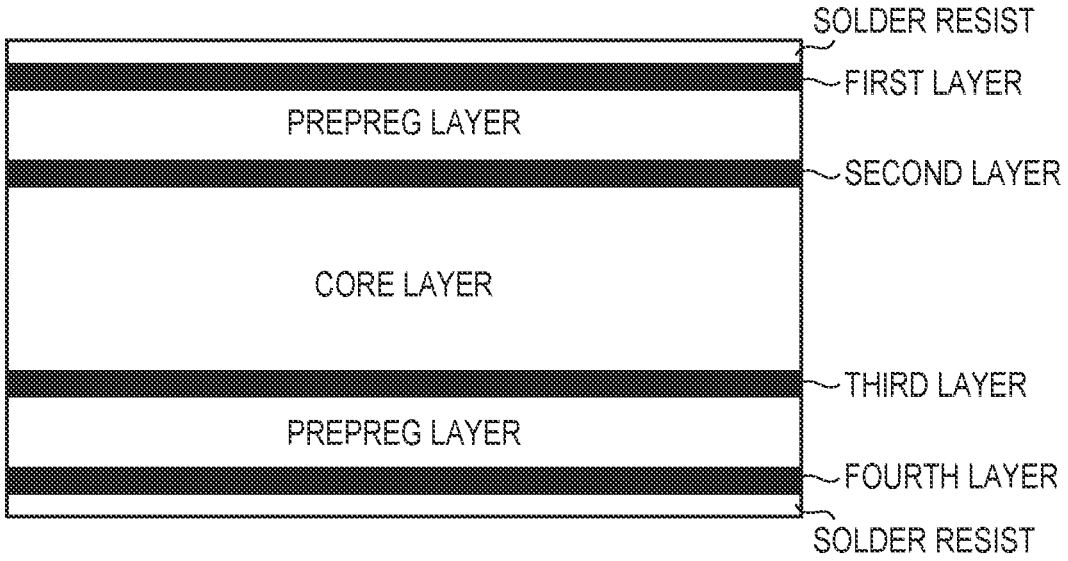
FIG. 8 is a sectional view of a substrate on which the band stop filter is to be formed.

The effect of this ground conductor will be described below. FIG. 8 is a view for explaining the layer arrangement of an electronic circuit substrate that can be used in each arrangement example including this arrangement example. Each black portion is a metal layer where the conductor pattern of a circuit or the ground conductor is arranged. A four-layer substrate is assumed here, and four metal layers of the first to fourth layers are arranged in the manner shown in FIG. 8. There are prepreg layers between the first and second layers, and between the third and fourth layers, and there is a core layer between the second and third layers. There is a solder resist to protect the conductor pattern of the circuit on the surface of each of the first and fourth layers. The stub according to each arrangement example described above is formed in the third layer. Note that the stubs of FIG. 2A are formed in, for example, the second and third layers.

Figure 7A:
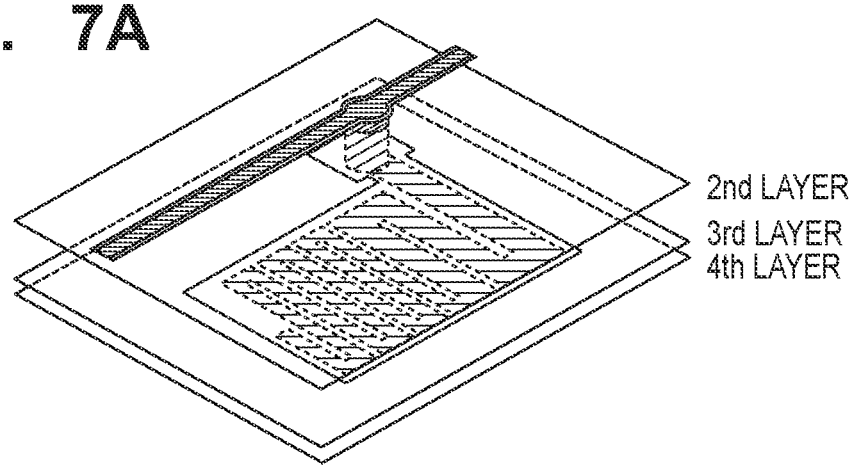
FIGS. 7A to 7C are views showing examples of the fourth arrangement of the band stop filter.

FIG. 7A shows the arrangement of a filter which is assumed to be mounted on a wireless LAN module substrate and which stops the propagation of electromagnetic waves in a 2.4-GHz band and a 5-GHz band. FIG. 7D shows a simulation result of the characteristic of a filter structure in FIG. 7A. This filter is applicable to, for example, an interface circuit that is to be mounted on a wireless LAN module substrate and emits noise in the 2.4 GHz band or the 5 GHz band. Note that FIG. 7A shows a structure in which a ground conductor arranged on the same surface as a signal line has been removed to help the understanding of the structure. However, although it is not shown, such a ground conductor is formed on the same surface, as a matter of course, in accordance with the principle of the coplanar line. As has been described in the third arrangement example, by decreasing the line width of the open end of the stub, it is possible to form a filter which stops both frequency bands of the 2.4-GHz band and the 5-GHz band. As is obvious from FIG. 7D, good attenuation characteristics are obtained in the both frequency bands of the 2.4-GHz band and the 5-GHz band by the filter structure of FIG. 7A.

Figure 7B:
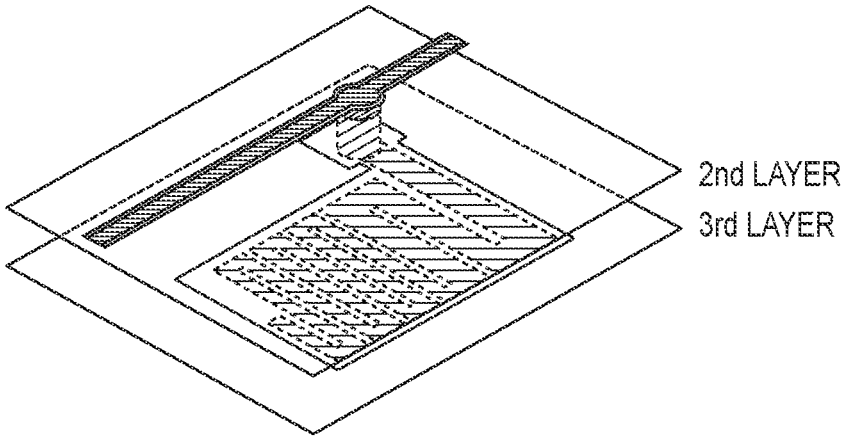

FIG. 7B shows a structure obtained by removing, from the structure of FIG. 7A, the ground conductor which is in a layer below the stub and is facing the layer where the stub is arranged. That is, it is an arrangement obtained by removing the ground conductor which is arranged in the fourth layer of FIG. 8. FIG. 7E shows a simulation result of the characteristic in FIG. 7B. Comparing FIG. 7D with FIG. 7E, it is found that both the first stopband and the second stopband further shift to the high frequency side in the characteristic of FIG. 7E as compared to that of FIG. 7D.

As described above, the total length of a resonance conductor needs a length equal to a quarter of an electrical length at the frequency of a stopband. That is, if the stopband is to be at a low frequency, the length of the resonance conductor has to be increased accordingly. In contrast, it is found, from the fact that both the first stopband and the second stopband further shift to the high frequency side in the characteristic of FIG. 7E as compared to that of FIG. 7D, that the ground conductor in the layer below the stub acts to make the electrical length of a current flowing onto the stub shorter. This is because in an arrangement which has a large-area ground conductor in a layer below the stub, the electrical length becomes shorter due to an increase in the phase constant of an electromagnetic wave propagating through the stub when the resonance conductor resonates. That is, it is possible to downsize the stub by arranging a planar ground conductor with a large area in a layer below the stub (a layer on a side opposite to a layer where the signal line is arranged when viewed from a layer where the stub is arranged).

Figure 7C:
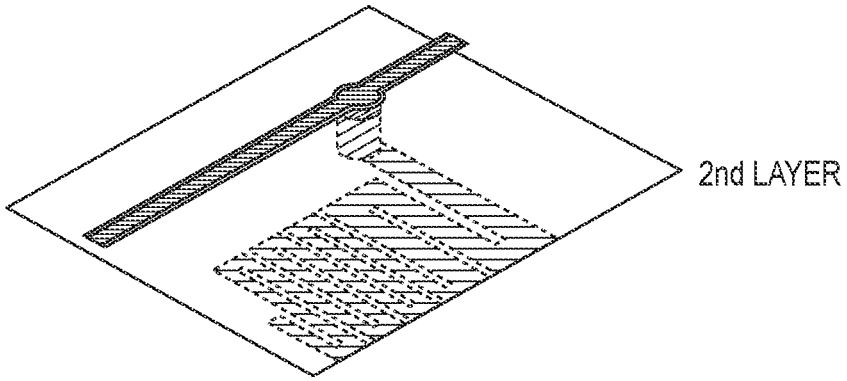
Figure 7D:
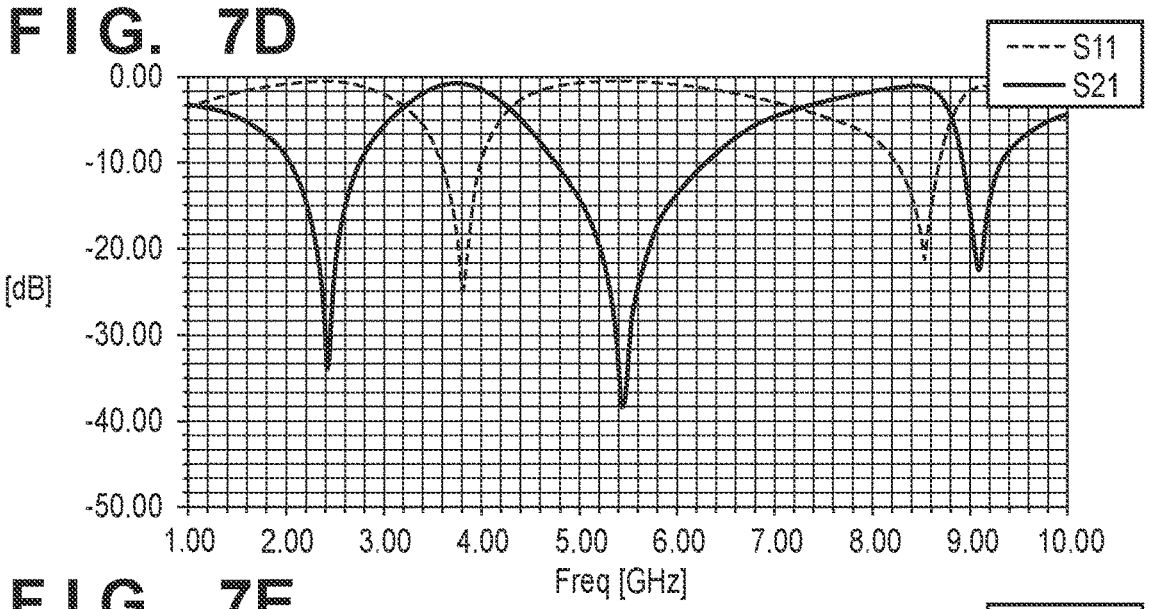
FIGS. 7D to 7F are graphs showing the characteristics of the band stop filter.
Figure 7E:
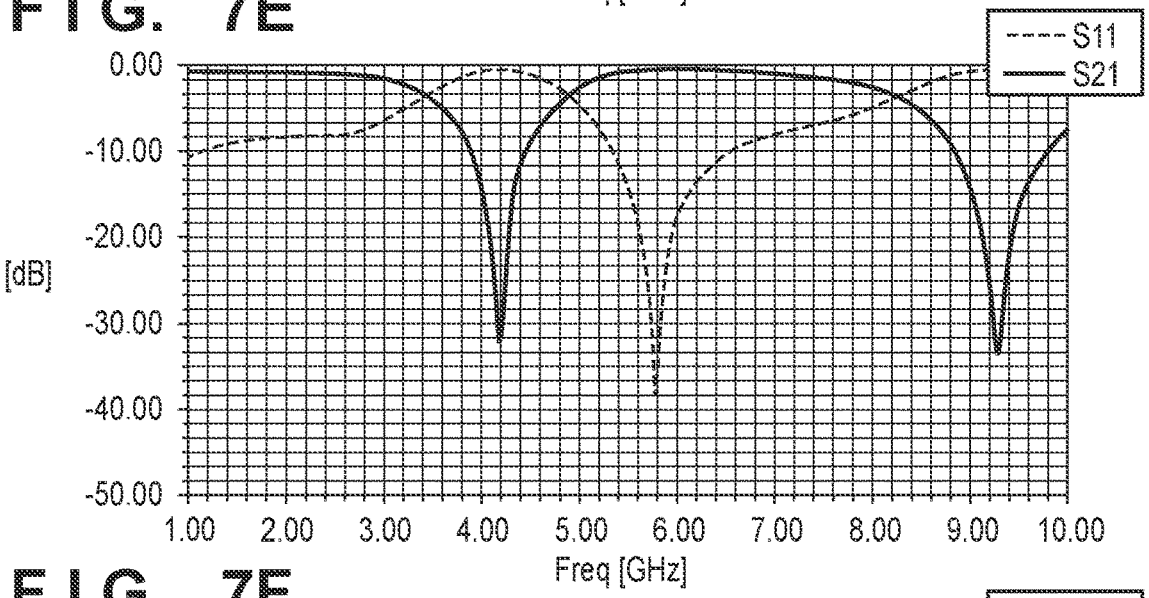
Figure 7F:
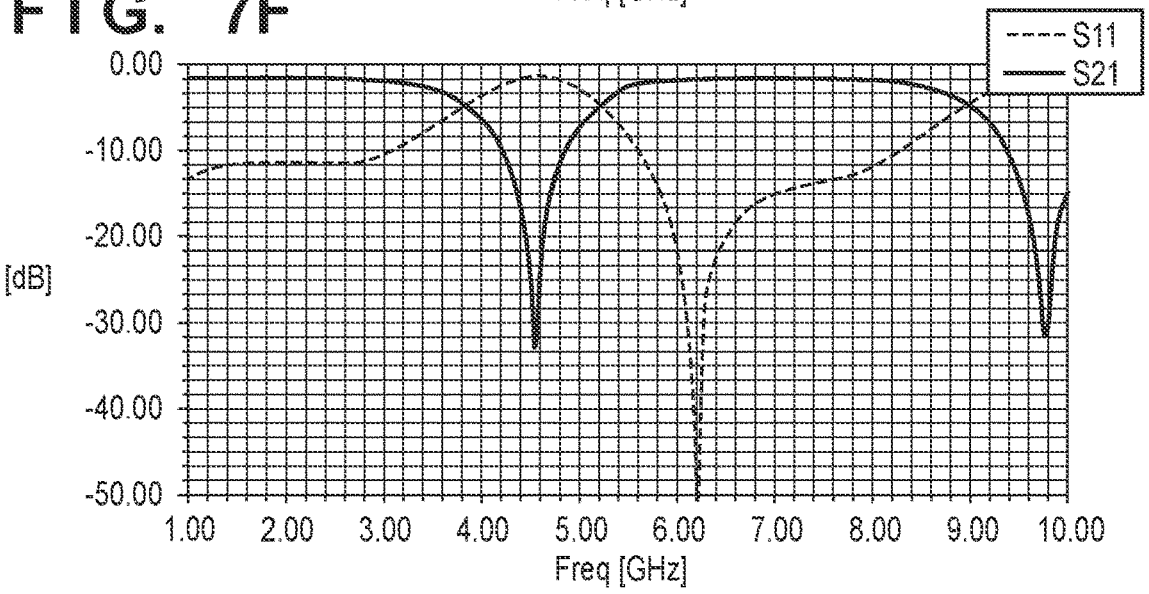

Next, FIG. 7C shows a structure obtained by further removing, from the structure of FIG. 7B, a ground conductor arranged in the same layer as the stub and arranged around the stub. That is, it is an arrangement obtained by removing the ground conductors arranged in the third and fourth layers shown in FIG. 8. FIG. 7F shows a simulation result of the characteristic in FIG. 7C.

Comparing the characteristic in FIG. 7E with that in FIG. 7F, it is found that both the first stopband and the second stopband further shift to the high frequency side in the characteristic of FIG. 7F as compared to that of FIG. 7E. From this, it can be understood that the ground conductor arranged around the stub acts to shorten the electrical length of the current flowing onto the stub. This is because in an arrangement in which there are large-area ground conductors present in layers above and below the stub, the electrical length becomes shorter due to an increase the phase constant of the electromagnetic wave propagating through the stub when the resonance conductor resonates. That is, it is possible to downsize the stub by arranging the ground conductor around the stub.

As described above, it is possible to downsize the resonance conductor by arranging the ground conductor around the resonance conductor including the via and the stub. If an electromagnetic wave (noise) in a frequency band of a stopband propagates through the transmission line, resonance may occur in the resonance conductor, thus emitting the electromagnetic wave (noise) into the space. To cope with this, by setting an arrangement in which the top and bottom of the stub are held by the ground conductors and in which the ground conductor is arranged around the stub as described in the first to third arrangement examples, an undesired electromagnetic wave, as that described above, can be prevented from being emitted into the space.

Fifth Arrangement Example

In this arrangement example, a filter structure that forms one resonance conductor by using a plurality of layers will be described. An effect obtained by removing some of the ground conductors arranged around the resonance conductor in such a structure will also be described. A substrate having the layer arrangement as that shown in FIG. 8 is also used in the filter structure according to this arrangement example.

Figure 9A:
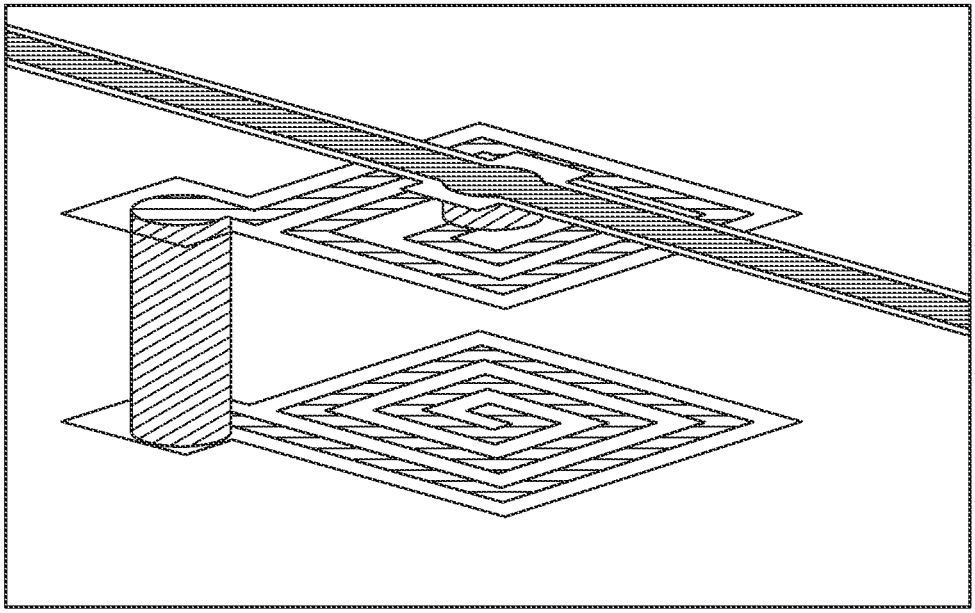
FIGS. 9A and 9B are a view showing an example of the fifth arrangement of the band stop filter and a graph showing the characteristics of the band stop filter, respectively.

FIG. 9A shows the structure of a band stop filter in which spiral-shaped stubs are formed in the second and third layers, respectively, of the arrangement in FIG. 8, and in which the ends of the stubs are connected to corresponding vias. The end of the stub which is formed in the second layer and is not connected to the stub in the third layer is connected to the signal line, and the end of the stub which is arranged in the third layer and is not connected to the stub in the second layer is an open end. In this manner, the area required per layer to form each stub arrangement is reduced by using two layers to form the stubs as described above, and the filter structure can be mounted even on a small electronic circuit substrate. Note that the structure of FIG. 9A also has an arrangement in which the ground conductors are formed in the first and fourth layers, respectively, so that the ground conductors are arranged above and below the stubs, respectively. Further, in the second layer and the third layer where the respective stubs are to be arranged, a ground conductor is arranged around each stub. As a result, as has been described in the second arrangement example, it is possible to downsize each stub and suppress the emission of noise into a space.

Figure 10A:
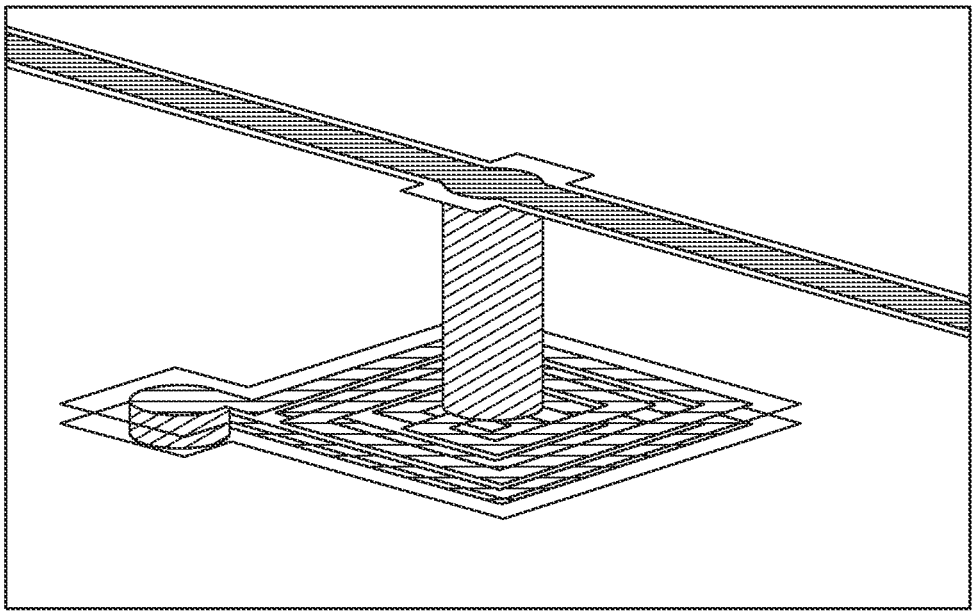
FIGS. 10A and 10B are a view showing an example of the fifth arrangement of the band stop filter and a graph showing the characteristics of the band stop filter, respectively.

FIG. 10A shows the structure of a band stop filter in which spiral-shaped stubs are formed in two layers, that is, the third and fourth layers, respectively, of the arrangement in FIG. 8, and the ends of the stubs are connected to corresponding vias. The end of the stub which is formed in the third layer and is not connected to the stub in the fourth layer is connected to the signal line, and the end of the stub which is formed in the fourth layer and is not connected to the stub in the third layer is an open end. This arrangement can also reduce the area required per layer to form each stub arrangement by using two layers to form the stubs, and the filter structure can be mounted even on a small electronic circuit substrate.

Figure 9B:
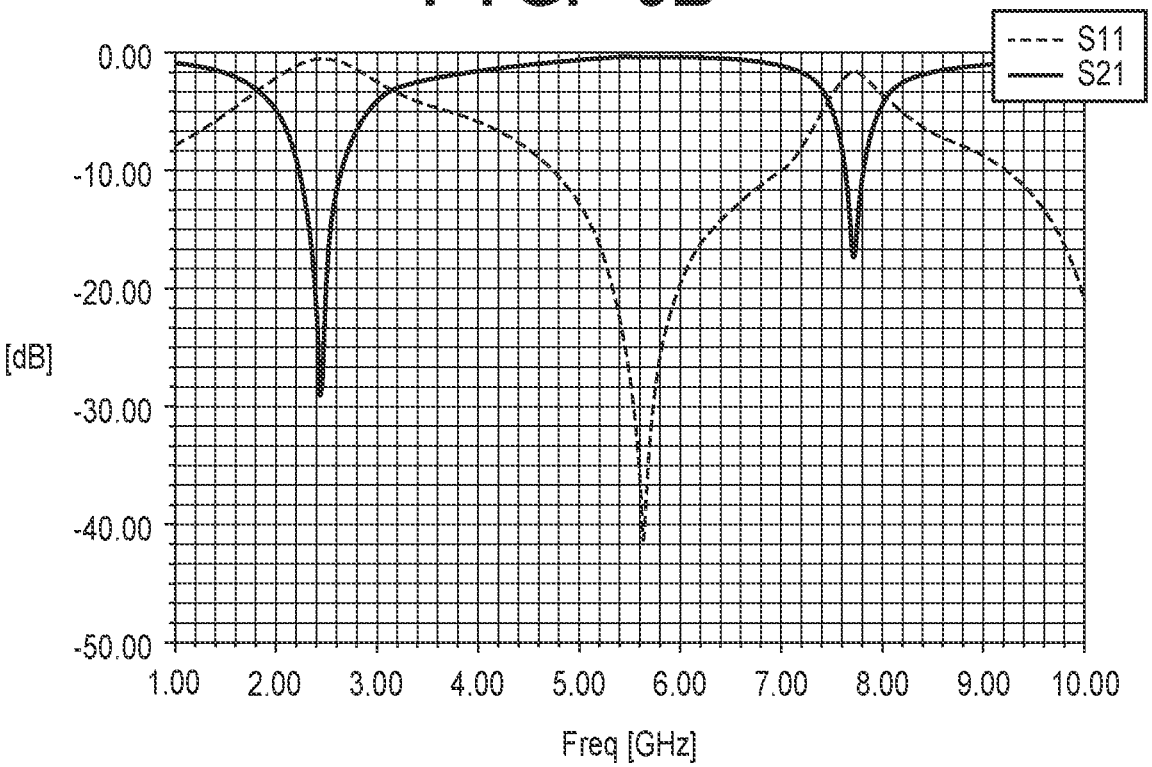
Figure 10B:
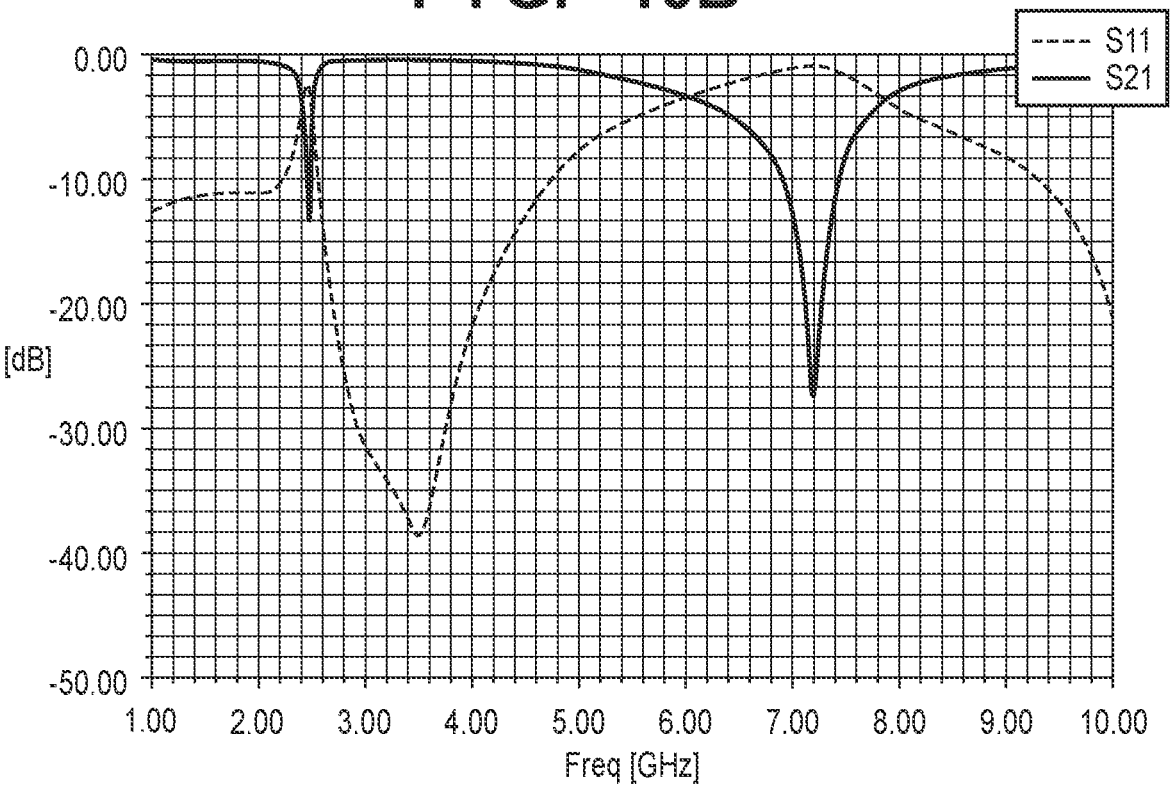

Note that in FIG. 10A, while a ground conductor is arranged in the second layer on the surface above the stub, a ground conductor is not formed on the surface below the stub. On the other hand, in the third and fourth layers where the stubs are arranged, ground conductors are arranged around the respective stubs. Note that each stub has a uniform line width, and the line widths of the stubs arranged in the third and fourth layers are 0.1 mm. Referring to FIG. 10B, it is apparent that the band widths of the first stopband and the second stopband become narrower than those of the characteristic related to the filter structure of FIG. 9A shown in FIG. 9B. It is considered that this is due to the weakening of the coupling between the stubs and the ground conductors. "Coupling" here refers to any type of electromagnetic coupling that can include electrostatic coupling (capacitive coupling), magnetic coupling (inductive coupling), or electromagnetic coupling in which both types of coupling are present. In a case in which an electromagnetic wave is to propagate through the signal line, if a band (passband) to be passed by the electromagnetic wave and each band (stopband) to stop the propagation of the electromagnetic wave are close to each other, the passband characteristic may be influenced by the large bandwidth of the stopband of the filter. In such a case, the bandwidth of the stopband can be reduced by removing some of the ground conductors arranged around the stubs as in FIG. 10A. In this case, however, it is apparent from referring to the transmission coefficient S21 of FIG. 10B that attenuation is reduced in accordance with the reduction of the bandwidth.

Figure 11A:
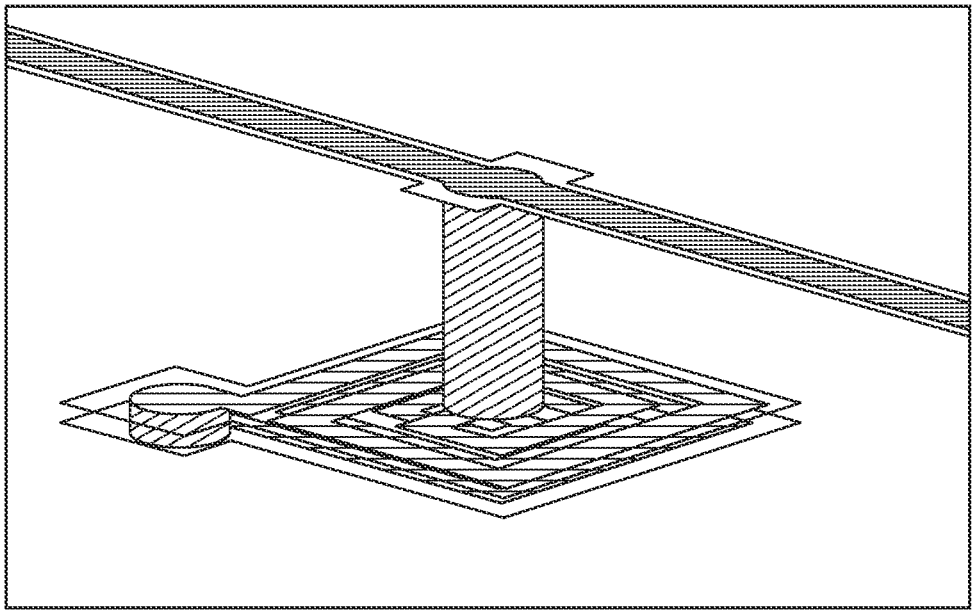
FIGS. 11A and 11B are a view showing an example of the fifth arrangement of the band stop filter and a graph showing the characteristics of the band stop filter, respectively.
Figure 11B:
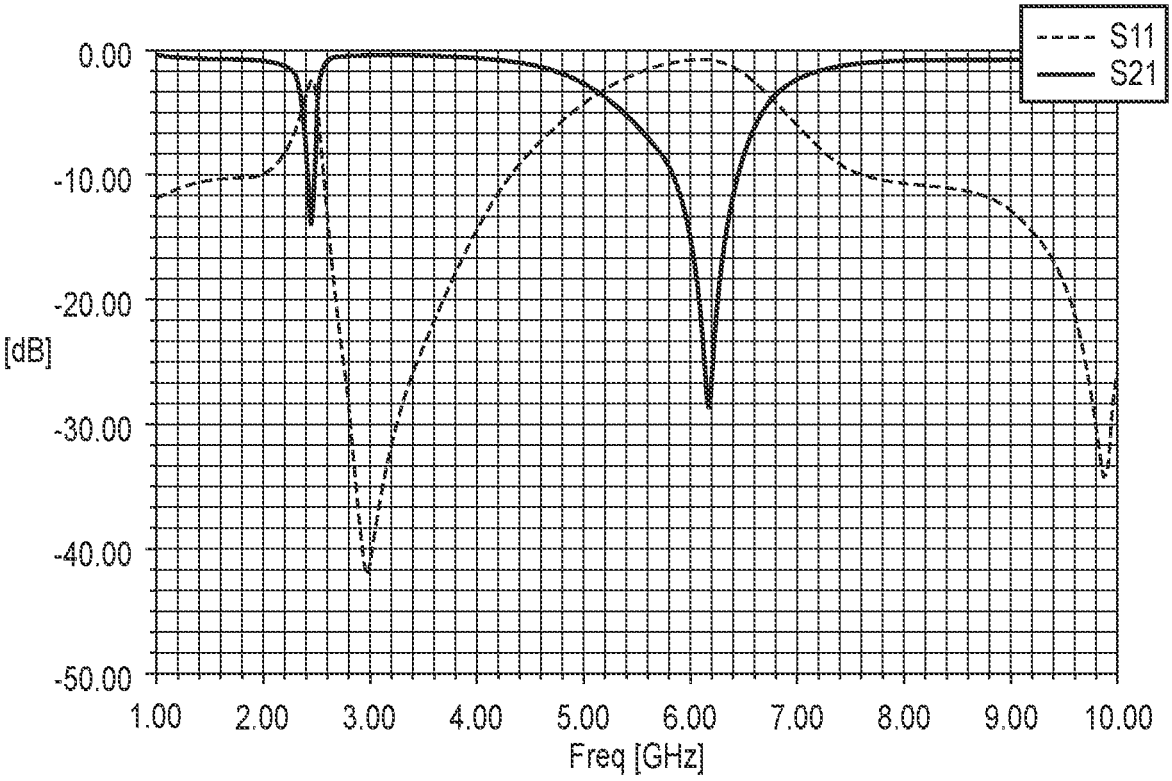

As in FIG. 10A, FIG. 11A shows a filter structure in which stubs are formed in two layers, the third and fourth layers, respectively. While a ground conductor is arranged in the second layer above the surface of the stub, a ground conductor is not arranged on the surface below the stub. In the third and fourth layers where the stubs are arranged, each ground conductor is arranged around the corresponding stub. Note that the line widths of the stubs are not uniform, the line width of the stub arranged in the third layer is 0.15 mm, and the line width of the stub arranged in the fourth layer is 0.05 mm. Comparing the characteristic in FIG. 10B with that in FIG. 11B, the second stopband of FIG. 11B is about 6.2 GHz, and the second stopband of FIG. 10B is 7.2 GHz. That is, it shows that the second stopband of a band stop filter in FIG. 11B is on a lower frequency side than the second stopband of the band stop filter in FIG. 10B. In the filter structure of FIG. 11A, the stub arranged in the third layer and the stub arranged in the fourth layer are connected by a via as described above. At this time, the stub arranged in the fourth layer corresponds to a stub on the side of the open end. Hence, it is possible to obtain the same effect as in the arrangement of the first arrangement example by narrowing the line width of the stub on the side of the open end. That is, by decreasing the line width of the portion of the open end of the stub and thus changing the line width ratio, the same effect as that of the third arrangement example can be obtained even in an arrangement, as that according to this arrangement example, in which the coupling between the stubs and the ground conductors is weakened due to the two-layer formation of the stubs. In the same manner, the effects as those described in the second and third arrangement examples can also be obtained by the band stop filter arrangement according to this arrangement example.

On the other hand, as described in the third arrangement example, the larger the area occupied by the stub line width is, the higher the attenuation is in the transmission coefficient S21. It is considered that this is because the coupling between the stubs and the ground conductors is strengthened in accordance with the increase in the area occupied by the stub line width. That is, in a case in which the coupling between the stubs and the ground conductors is strong, a large attenuation characteristic is obtained, and the bandwidth of the stopband becomes large in a desired frequency band. On the other hand, in a case in which coupling between the stubs and the ground conductors is weak, a small attenuation characteristic is obtained, and the bandwidth of the stopband becomes small in the desired frequency band. The coupling between the stubs and the ground conductors can be strengthened by increasing the stub line width, arranging a ground conductor around each stub, or decreasing the distance between the stubs and the ground conductors. On the other hand, the coupling between the stubs and the ground conductors can be weakened by reducing the stub line width, increasing the distances between the stubs and the ground conductors, or removing the ground conductor near the stub.

(Arrangement of Branch Circuit)

Figure 12:
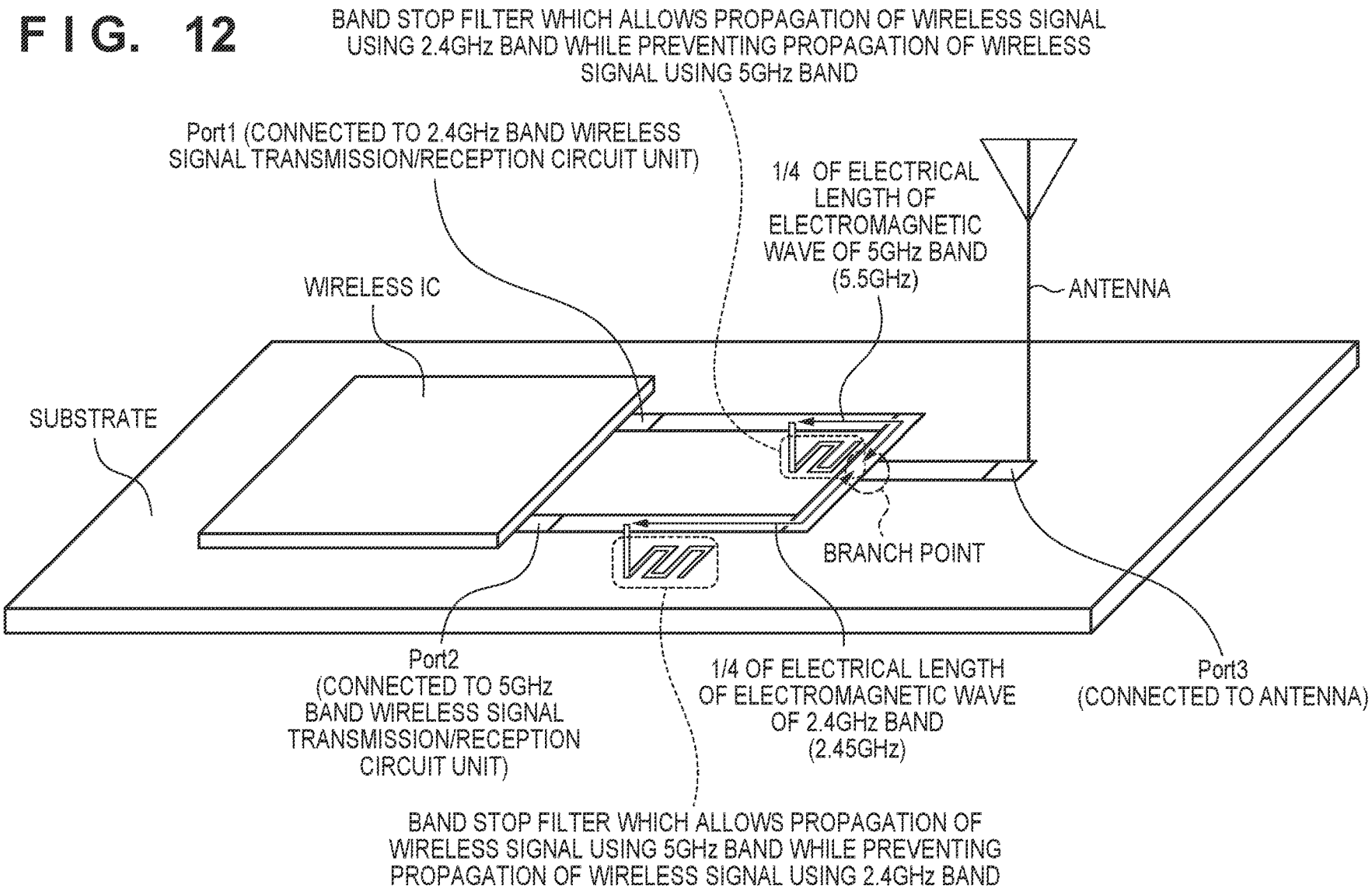
FIG. 12 is a view showing an example of the arrangement of a branch circuit in a wireless communication apparatus.

The arrangement of a branch circuit which uses a band stop filter formed by a conductor pattern as that described above will be described next. In the arrangement of the branch circuit according to this embodiment, a plurality of the band stop filters according to the first to third arrangement examples are arranged in the branch circuit. FIG. 12 shows an example of the arrangement of the branch circuit according to this embodiment. Note that there will be described below a branch circuit that has a function of a so-called diplexer in which a transmission line, to which an electromagnetic wave received by an antenna is input, is branched into two transmission lines, and electromagnetic waves belonging to different frequency bands of the electromagnetic wave are propagated through the respective two branched transmission lines. However, the present invention is not limited to this, and it is possible to arrange a branch circuit that is branched by using transmission lines that have three or more different frequency characteristics in accordance with the following explanation. Note that, hereinafter, in order to describe a case using two branches, a function of controlling the frequency characteristic of the above-described electromagnetic wave to be propagated of the branch circuit according to this embodiment will be referred to as a "diplexer function". Note that in this embodiment, it is assumed that the branch circuit will be applied to a wireless LAN in compliance with IEEE802.11 standard series, and that the branch circuit will be arranged between a multiband antenna supporting a 2.4-GHz band and a 5-GHz band and two transmission/reception circuit units for performing wireless communication in the respective frequency bands. That is, the branch circuit according to this embodiment is connected to one antenna, a first transmission/reception circuit unit configured to perform wireless communication by using a first frequency band (2.4-GHz band), and a second transmission/reception circuit unit configured to perform wireless communication by using a second frequency band (5-GHz band). Note that the 2.4-GHz band is a frequency band used to perform wireless communication in compliance with IEEE802.11b/g/n/ax standards and that the 5-GHz band is a frequency band used to perform wireless communication in compliance with IEEE802.11a/n/ac/ax standards. FIG. 12 shows an example in which the branch circuit is connected to the first transmission/reception circuit unit, the second transmission/reception circuit unit, and the antenna by Port1, Port2, and Port3, respectively.

In this kind of arrangement, the branch circuit has a first conductor pattern (first stub) that connects a branch point and Port1, is connected to a first conductor (signal line) through which an electromagnetic wave in the 2.4-GHz band is propagated, and cuts off the electromagnetic wave in the 5-GHz band. This allows the conductor pattern connected to the first conductor to attenuate or cut off the electromagnetic wave in the 5-GHz band, which has been output from the second transmission/reception circuit unit to Port2, before the electromagnetic wave reaches the first transmission/reception circuit unit. On the other hand, the branch circuit also has a second conductor pattern (second stub) that connects the branch point and Port2, is connected to a second conductor (signal line) through which the electromagnetic wave in the 5-GHz band is propagated, and cuts off the electromagnetic wave in the 2.4-GHz band. Note that each stub is connected to the corresponding conductor (signal line) by a via. This allows the conductor pattern connected to the second conductor to attenuate or cut off the electromagnetic wave in the 2.4-GHz band, which has been output from the first transmission/reception circuit unit to Port1, before the electromagnetic wave reaches the second transmission/reception circuit unit. In this manner, in the branch circuit according to this embodiment, the conductor pattern can be used to prevent an electromagnetic wave that has been output from one transmission/reception circuit unit from entering another transmission/reception circuit unit. Since this prevents each electromagnetic wave output from the first transmission/reception circuit unit and the second transmission/reception circuit unit from entering the other transmission/reception circuit unit, the electromagnetic wave is input to and emitted by the antenna with little loss. In the same manner, for an electromagnetic wave received by the antenna and containing 2.4-GHz band and 5-GHz band components, the first conductor attenuates or cuts off the 5-GHz band components, and an electromagnetic wave mainly containing the 2.4-GHz band components is input to the first transmission/reception circuit unit. Additionally, the 2.4-GHz band components of an electromagnetic wave received by the antenna are attenuated or cut off by the second conductor, and an electromagnetic wave mainly containing the 5-GHz band components is input to the second transmission/reception circuit unit.

Note that FIG. 12 shows an example in which Port3 connected to the antenna and the branch point of the branch circuit are connected by a third conductor (signal line). However, the present invention is not limited to this, and the antenna may be directly connected to the branch point. That is, the branch circuit suffices to have an arrangement in which at least two conductors, each connected to a conductor pattern for obtaining a different frequency characteristic, are connected to a branch point where at least one of input and output of an electromagnetic wave is to be performed. In this case, the branch point where at least one of the input and the output of an electromagnetic wave is to be performed may be used as Port3, and the third conductor may be omitted.

A band stop filter (second stub) which is to be arranged in the second conductor will be described here. The second stub functions, in the second conductor, as a band stop filter that allows the propagation of an electromagnetic wave in the 5-GHz band while preventing the propagation of an electromagnetic wave in the 2.4-GHz band. That is, the second stub has a function that transmits an electromagnetic wave in the 5-GHz band and reflects a 2.4-GHz signal. First, a case in which a band stop filter that has a meander-shaped conductor with a uniform line width, as that shown in FIGS. 1A and 1B, is used as the band stop filter will be considered. In this case, since it can be seen from the transmission coefficient S21 of FIG. 1C that an attenuation of 20 dB or more is ensured in the 2.4-GHz band, it can be said that an electromagnetic wave in the 2.4-GHz band can be sufficiently attenuated. On the other hand, an attenuation of a maximum of about 3 dB has been generated also in the 5-GHz band (5 GHz to 6 GHz) for the transmission coefficient S21, and it can be seen that a loss will also occur at the propagation of a 5-GHz-band signal. Hence, in order to further reduce the attenuation in the 5-GHz band while ensuring the attenuation in the 2.4-GHz band, a stopband that is generated at 7.1 GHz which is a stopband (attenuation band) on the side of the high frequency band may shift to a higher frequency band. This can be implemented by using, as described in the second arrangement example, a band stop filter whose line width of a portion including the open end in a linear conductor portion of a stub has been arranged to be larger than the line width of other portions in the linear conductor portion.

Figure 13A:
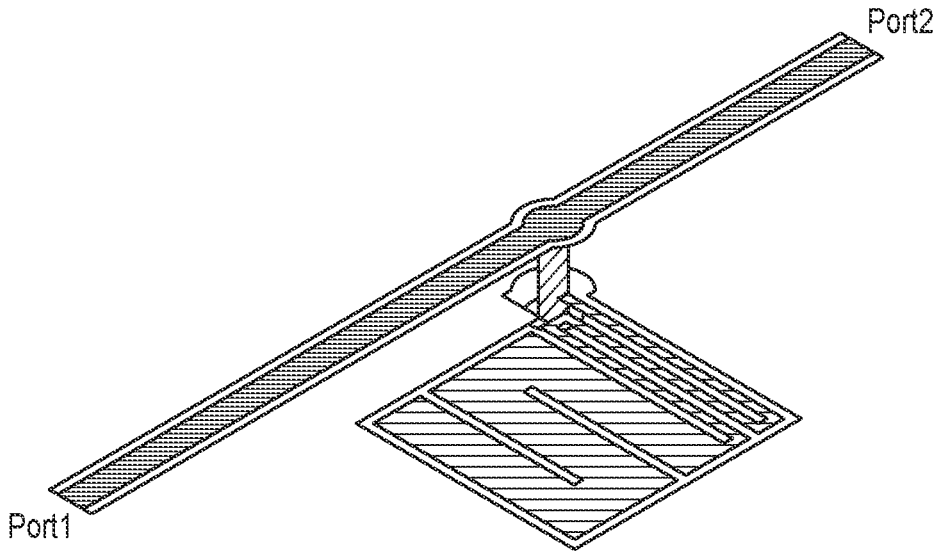
FIGS. 13A and 13B are a view showing an example of a stub which is to be connected to a second conductor, and a graph showing the characteristics of the stub to be connected to the second conductor.
Figure 13B:
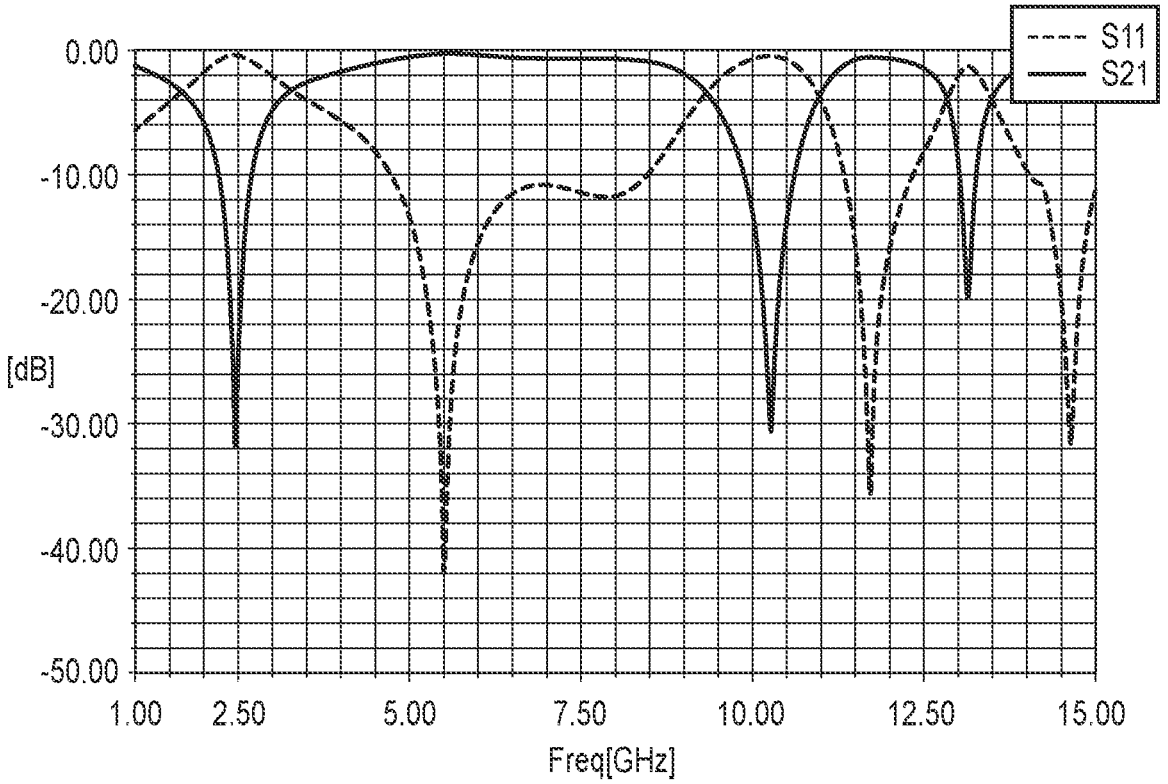

FIG. 13A shows an arrangement example of a band stop filter which is to be connected to the second conductor to allow the propagation of a signal in the 5-GHz band while preventing the propagation of a signal in the 2.4-GHz band in the second conductor, and FIG. 13B shows the characteristics of this band stop filter. In this arrangement example, the linear conductor portion of the band stop filter has been formed to have a first line width portion and a second line width portion as in the second arrangement example described above. As is obvious from the transmission coefficient S21 of FIG. 13B, stopbands are present in the 2.4-GHz band and at 10.3 GHz, respectively, and the stopband on the high frequency side has further shifted toward the high frequency side compared to the arrangement using the conductor with the uniform line width as shown in FIGS. 1A and 1B. Furthermore, it is apparent from FIG. 13B that the signal loss in the 5-GHz band has fallen within 1 dB in accordance with this shifting of the stopband to the high frequency side. In this manner, by using an arrangement as shown in FIG. 13A, it is possible to cause an electromagnetic wave in the 5-GHz band to propagate at a sufficiently low loss and prevent an electromagnetic wave in the 2.4-GHz band from propagating at a significant level. As described above, it is possible to reduce the attenuation within the frequency range of the electromagnetic wave to be propagated in the second conductor by causing the stopband on the high frequency side to shift further on the high frequency side by the changing the lengths of the first line width portion and the second line width portion in accordance with the frequency of the electromagnetic wave to be propagated in the second conductor. Note that in a case in which the attenuation can be reduced within the frequency range of the electromagnetic wave to be propagated in the second conductor by causing the stopband on the high frequency side to shift to the low frequency side, a stub having an arrangement, for example, as that of the above-described third arrangement example may be used.

Figure 14A:
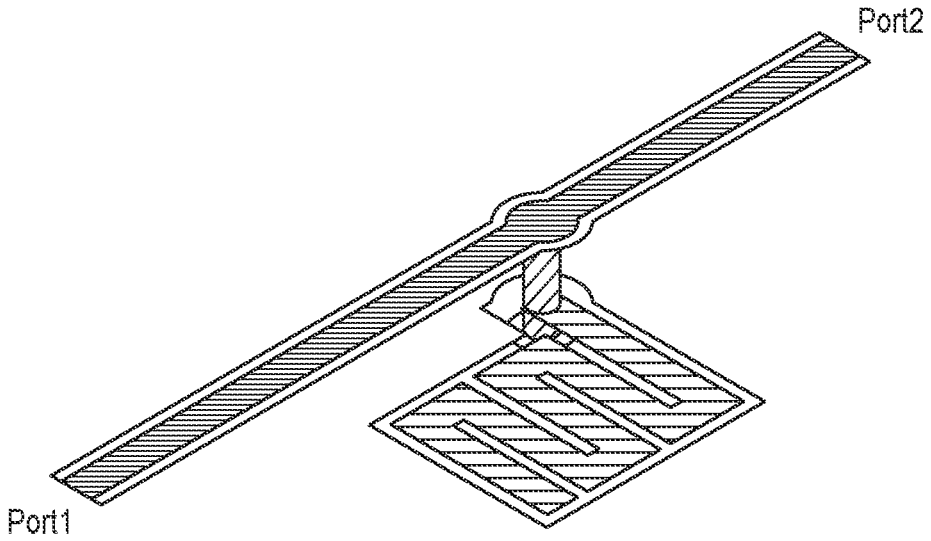
FIGS. 14A and 14B are a view showing an example of a stub which is to be connected to a first conductor and a graph showing the characteristics of the stub to be connected to the first conductor.
Figure 14B:
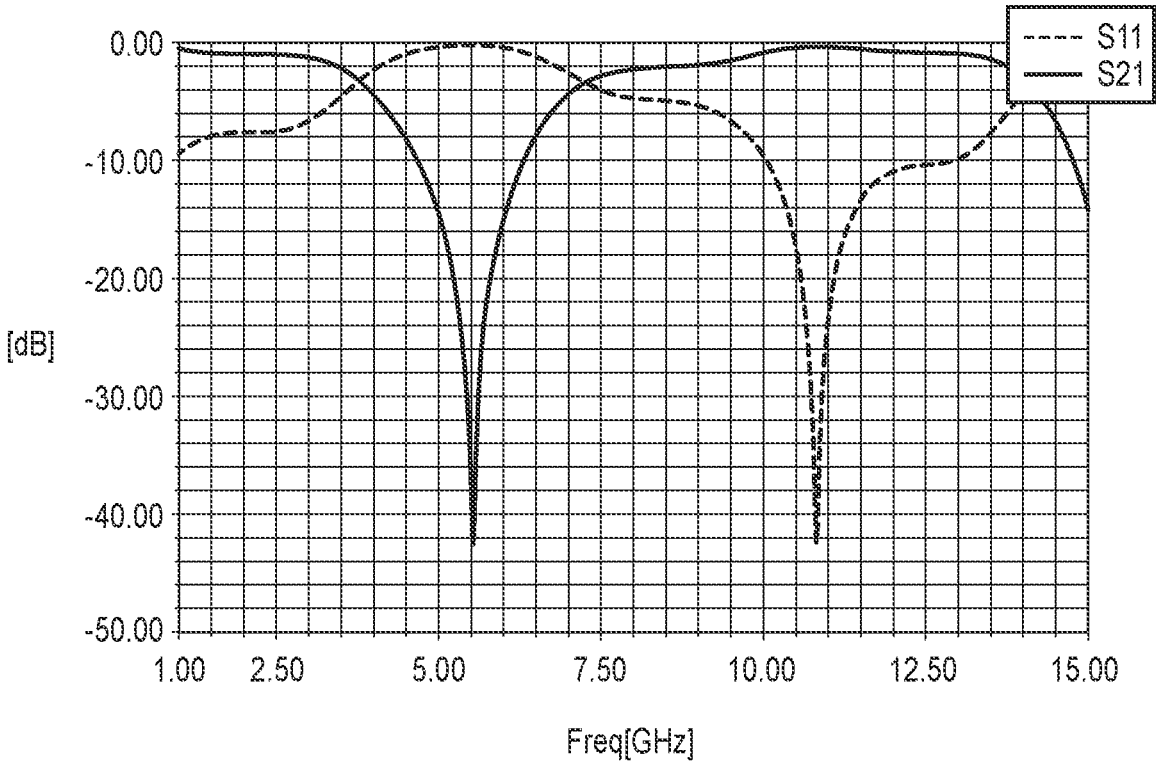

The band stop filter (first stub) to be arranged in the first conductor will be described next. The first stub functions, in the first conductor, as a band stop filter that allows the propagation of an electromagnetic wave in the 2.4-GHz band while preventing the propagation of an electromagnetic wave in the 5-GHz band. That is, the first stub has a function that transmits an electromagnetic wave in the 2.4-GHz band and reflects a 5-GHz signal. FIG. 14A shows this arrangement example, and FIG. 14B shows the frequency characteristic of this arrangement example. As is obvious from the transmission coefficient S21 of FIG. 14B, the attenuation of the electromagnetic wave in the 2.4-GHz band falls within 1 dB, and an attenuation of 20 dB or more has been ensured in the 5-GHz band. Note that the first stub has a uniform line width here as shown in FIG. 14A. However, the present invention is not limited to this, and for example, the first stub can be arranged so as to include a plurality of portions that have different line widths from each other when the attenuation of the electromagnetic wave in the 2.4-GHz band needs to be suppressed.

Note that a stub may be formed so that, for example, a frequency on the high frequency side will match a target stopband by adjusting the line width so as to make the stopband frequency on the high frequency side higher than the target stopband and extending the conductor length of the stub upon this adjustment. Since this extension of the conductor length will cause the stopbands to shift overall to the low frequency side, it will allow the stopband on the low frequency side to shift further to the low frequency side while setting the stopband frequency on the high frequency side to the target frequency. In the same manner, a stub may also be formed so that a frequency on the high frequency side will match a target stopband by adjusting the line width so as to make the stopband frequency on the high frequency side lower than the target stopband and shortening the conductor length of the stub upon this adjustment. Since this shortening of the conductor length will cause the stopbands to shift overall to the high frequency side, it will allow the stopband on the low frequency side to shift to the high frequency side while setting the stopband frequency on the high frequency side to the target frequency. That is, by causing the stopband to shift to one of the high frequency side and the low frequency side based on the target frequency and the frequency characteristic of the stub, the ratio of lengths between conductor portions with different line widths, the line width ratio, the conductor length of the stub, and the like can be determined.

Arrangement Example A

Figure 15A:
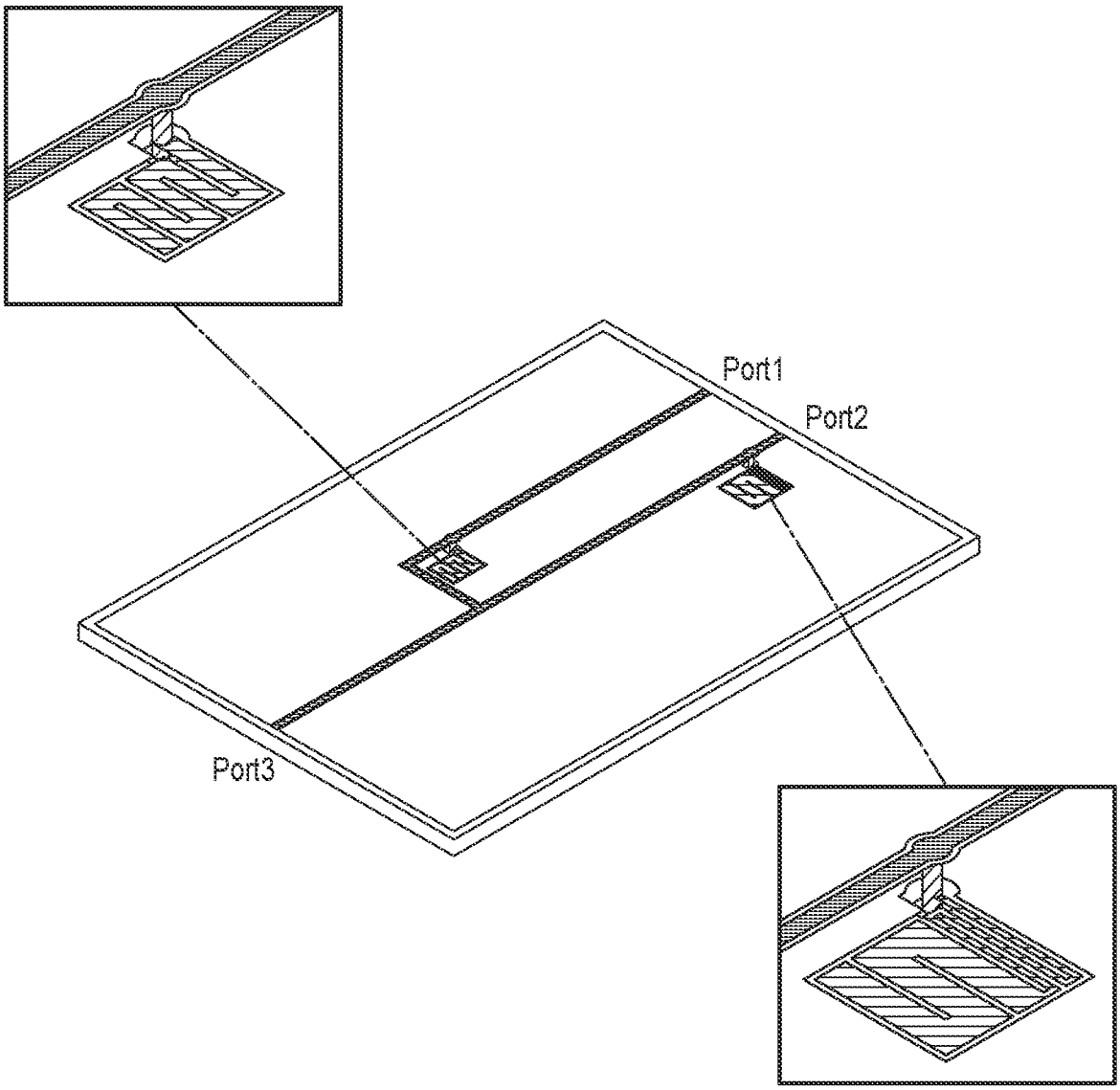
FIGS. 15A and 15B are a view showing an example of the first arrangement of the branch circuit and a graph showing the characteristics the branch circuit, respectively.

An arrangement example of a branch circuit in which two stubs as those described above are each connected to a corresponding one of two conductors to be branched and the characteristic of this arrangement example will be described next with reference to FIGS. 15A and 15B. The positions at which these stubs are connected to the respective conductors will be described first.

An electromagnetic wave in the 2.4-GHz band needs to be propagated between Port1 and Port3 while preventing the propagation of a signal in the 5-GHz band. Hence, it will be set so that a circuit on the side of Port2 will be seen as an open end to which nothing is electrically connected from the branch point for the electromagnetic wave in the 2.4-GHz band. This can be implemented in the second conductor by arranging the second stub, which was shown in FIG. 13A, at a position apart from the branch point by a conductor length which is approximately a quarter of the electrical length of 2.45 GHz (the center frequency in the 2.4-GHz band). Note that the above-described electrical length is the electrical length of the coplanar line which serves as the transmission line. As shown by the frequency characteristics of FIG. 13B, the band stop filter of FIG. 13A can reflect a signal in the 2.4-GHz band. That is, at the point where the band stop filter shown in FIG. 13A is arranged, the impedance is almost 0 for an electromagnetic wave in the 2.4-GHz band, and thus it can be handled in the same manner as when a signal line has been electrically grounded. Therefore, when the Port3 side is seen from a point apart on the opposite side from Port3 by an electrical length of approximately a quarter of 2.45 GHz from the point where the second stub of FIG. 13A is arranged, it seems to be an open end to which nothing is electrically connected. As described above, by arranging, in the second conductor, the second stub, which reflects an electromagnetic wave in the 2.4-GHz band, at a position apart from the branch point by a length corresponding to the electrical length of the electromagnetic wave in the 2.4-GHz band, it becomes possible to prevent the propagation of the electromagnetic wave in the 2.4-GHz band to the Port2 side.

In the same manner, an electromagnetic wave in the 5-GHz band needs to be propagated between Port2 and Port3 while preventing the propagation of an electromagnetic wave in the 2.4-GHz band. Hence, it will be set so that a circuit on the side of Port1 will be seen as an open end from the branch point for the electromagnetic wave in the 5.4-GHz band. This can be implemented in the first conductor by arranging the first stub, which was shown in FIG. 14A, at a position apart from the branch point by a conductor length which is approximately a quarter of the electrical length of 5.5 GHz (the center frequency in the 5-GHz band). Note that the above-described electrical length is the electrical length of the coplanar line which serves as the transmission line. As shown by the frequency characteristics of FIG. 14B, the band stop filter of FIG. 14A can reflect the electromagnetic wave in the 5-GHz band. Hence, with respect to a signal in the 5-GHz band, it can be handled in the same manner as it is electrically grounded at the point where the band stop filter shown in FIG. 14A is arranged. Therefore, when the Port1 side is seen from a point apart on the opposite side from Port1 by a conductor length of approximately a quarter of the electrical length of 5.5 GHz from the point where the first stub of FIG. 14A is arranged, it seems to be in an electrically open state. As described above, by arranging, in the first conductor, the first stub, which reflects an electromagnetic wave in the 5-GHz band, at a position apart from the branch point by a length corresponding to the electrical length of the electromagnetic wave in the 5-GHz band, it becomes possible to prevent the propagation of the electromagnetic wave in the 5-GHz band to the Port1 side.

Figure 15B:
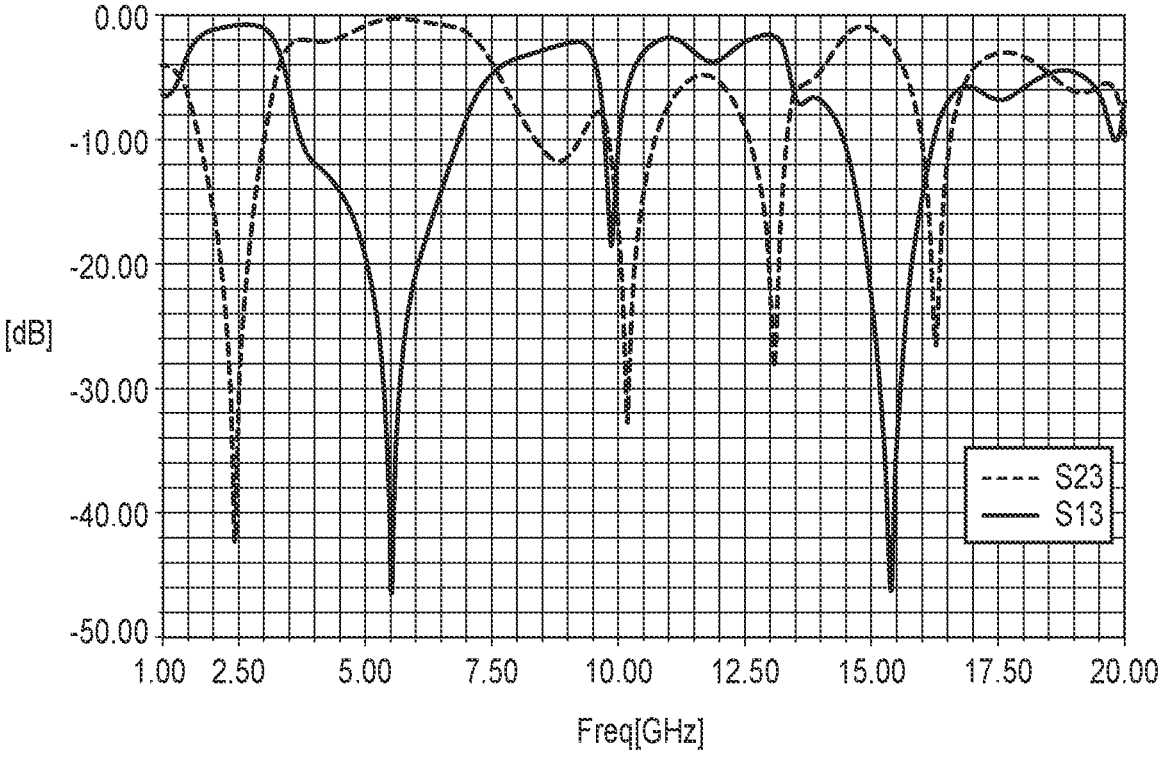

In FIG. 15B, it is apparent from reference symbol S13 representing a signal transmission coefficient from Port3 to Port1 that the loss of an electromagnetic wave in the 2.4-GHz band falls within 1 dB and that the electromagnetic wave is propagated from the Port3 to Port1 with little loss. Also, since an attenuation of 20 dB or more is ensured between Port3 and Port1 for an electromagnetic wave of the 5-GHz band, it is apparent that the electromagnetic wave in the 5-GHz band is barely propagated (is at least highly attenuated) from Port3 to Port1. In addition, it is apparent from S23 representing an electromagnetic wave transmission coefficient from Port3 to Port2 that the loss of an electromagnetic wave in the 5-GHz band falls within 1 dB and that the electromagnetic wave is propagated from the Port3 to Port2 with little loss. Also, since an attenuation of 20 dB or more is ensured for an electromagnetic wave of the 2.4-GHz band, it is apparent that the electromagnetic wave in the 2.4-GHz band is barely propagated (is at least highly attenuated) from Port3 to Port2. By arranging, in the above-described manner, stubs that function as the above-described band stop filters at predetermined positions in the branch circuit, the function of the diplexer can be implemented.

Note that, as described above, a transmission line of a predetermined conductor length is required from the branch point to a point where each stub is connected. In the example of FIG. 15A, the second conductor is formed by a linear transmission line, and the first conductor is formed by a linear transmission line that has a bent portion. However, the shapes of these transmission lines are not limited to these, and a transmission line that has, for example, a plurality of bent portions such as that having a meander shape may be used. This can shorten the total length in one direction of the branch circuit and allow downsizing (shortening of the length of one side of a region where at least the circuit is to be formed) of the circuit overall. In addition, in the same manner, the shape of the transmission line of the third conductor that connects the branch point to Port3 for performing input/output need not be linear.

In the above-described manner, according to this arrangement example, the first stub and the second stub, which has a different characteristic than the first stub (that is, which has at least a different shape from the first stub), are connected to the first conductor and the second conductor, respectively, that have been obtained by branching the transmission line into at least two branches from a predetermined branch point. At this time, a length (first length) between the branch point and the point (first point) where the first stub is connected to the first conductor is a length corresponding to the characteristic (for example, the frequency characteristic or the conductor length/shape of the stub) of the first stub. Also, a length (second length) between the branch point and the point (second point) where the second stub is connected to the second conductor is a length corresponding to the characteristic (for example, the frequency characteristic or the conductor length/shape of the stub) of the second stub. For example, the longer the conductor length of the stub is, the stub can be connected to a conductor in a position away from the branch point. In addition, a position where the stub is to be connected may be determined by the shape or the frequency characteristic regardless of the conductor length of the stub. The first stub may be designed in accordance with the electromagnetic frequency to be propagated in the second conductor, and the second stub may be designed in accordance with the electromagnetic frequency to be propagated in the first conductor. In the same manner, the first stub may be designed in accordance with the electromagnetic frequency to be propagated in the second conductor, and the second stub may be designed in accordance with the electromagnetic frequency to be propagated in the first conductor. As a result, a branch circuit that has a diplexer function can be formed on an electronic circuit substrate by using an inexpensive small circuit pattern.

Arrangement Example B

The arrangement example A described a branch circuit in which two stubs were each connected to a corresponding one of two branched conductors. This arrangement example further develops the arrangement described in the arrangement example A, and describes an arrangement of a branch circuit in which suppression of a harmonic component that may be output from the first transmission/reception circuit unit has been considered. Note that a description of the same arrangements as those of the arrangement example A will be omitted.

Generally, although a predetermined wireless frequency signal is output from the wireless IC, there are cases in which a harmonic component is generated at the time of the output. If a component that has the wireless frequency of the signal is assumed to be the fundamental wave, a component with double the frequency of the fundamental wave is referred to as the second harmonic, a component with triple the frequency of the fundamental wave is referred to as the third harmonic, and a component with n times the fundamental wave is referred to as the nth harmonic. When the harmonics that have been generated from the wireless IC are emitted from the antenna, they can become noise and have negative influences such as electromagnetic interference on peripheral electronic devices and equipment. Hence, there is a need to prevent the harmonic noise from being emitted from the antenna if the harmonic noise has been generated. This arrangement example will describe a branch circuit that has a diplexer function in which prevention of the emission of harmonic noise from the antenna has been considered.

First, harmonic frequencies that may be generated from the first transmission/reception circuit unit will be considered. The second and third harmonics will be considered here. The first transmission/reception circuit unit can output an electromagnetic wave in the 2.4-GHz band which is the fundamental wave, but it can also simultaneously output an electromagnetic wave of 4.8 GHz to 5 GHz which is the second harmonic and an electromagnetic wave of 7.2 GHz to 7.5 GHz which is the third harmonic. Here, from the transmission characteristic S13 between Port1 and Port3 of the arrangement example A shown in FIG. 15B, it can be understood that attenuation is equal to or more than 15 dB in the range of 4.8 GHz to 5 GHz, and that the second harmonic component which can be output from the first transmission/reception circuit unit is hardly propagated between Port1 and Port3.

Figure 19A:
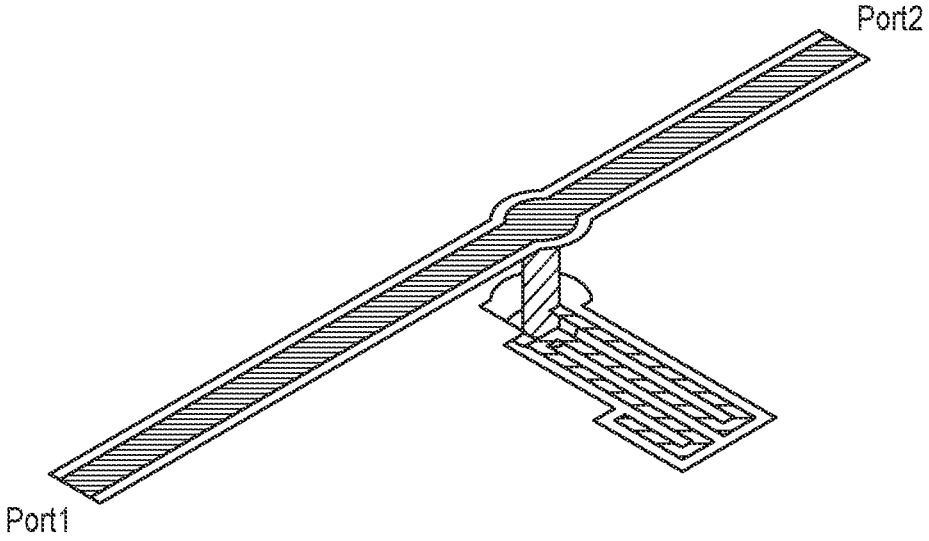
FIGS. 19A and 19B are a view showing an example of the arrangement of a band stop filter for stopping the propagation of harmonics and a graph showing the characteristics of the band stop filter, respectively.
Figure 19B:
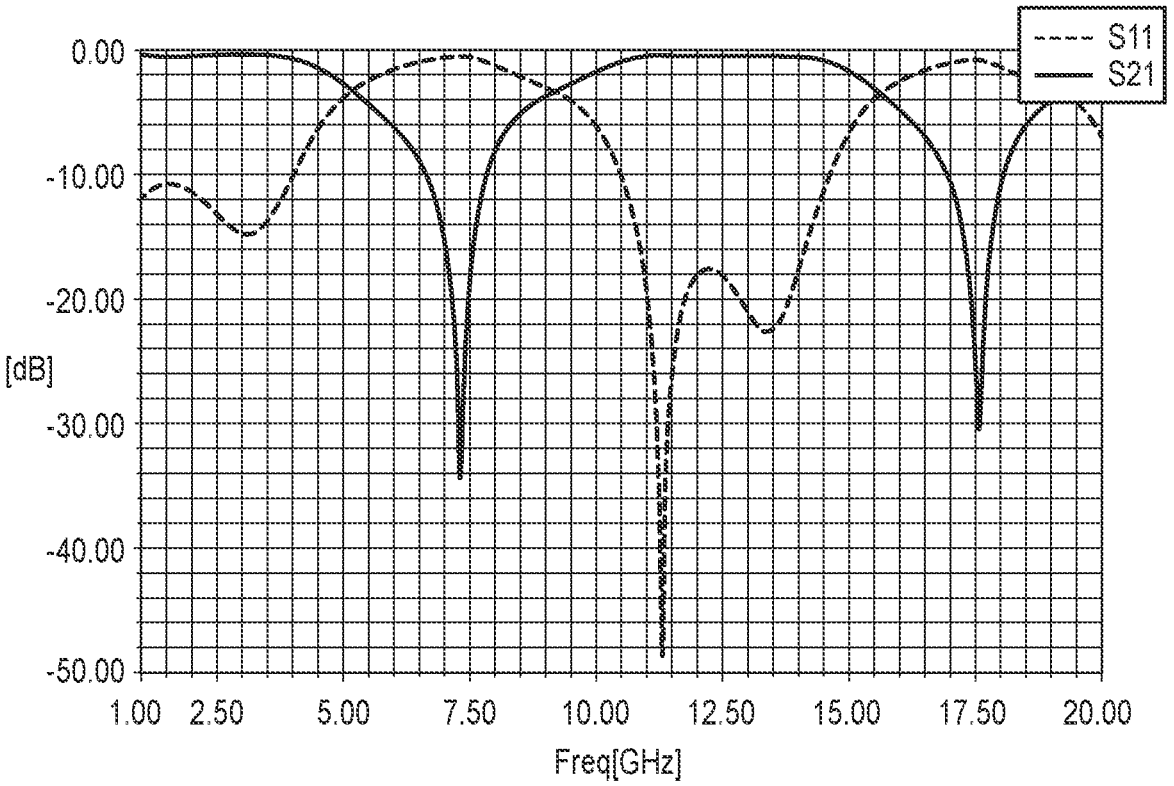

In this arrangement example, a band stop filter is combined with the structure of the arrangement example A so that the third harmonic, which may be output from the first transmission/reception circuit unit, will be hardly propagated between Port1 and Port3 to which the antenna is connected. FIGS. 19A and 19B show the arrangement of a stub which is arranged to stop the propagation of an electromagnetic wave of 7.2 GHz to 7.5 GHz which is the third harmonic that may be output from the first transmission/reception circuit unit and the frequency characteristic of this arrangement, respectively. As shown in FIG. 19B, it can be seen that the transmission coefficient S21 is reduced in the range of 7.2 GHz to 7.5 GHz by the arrangement of FIG. 19A.

Figure 16A:
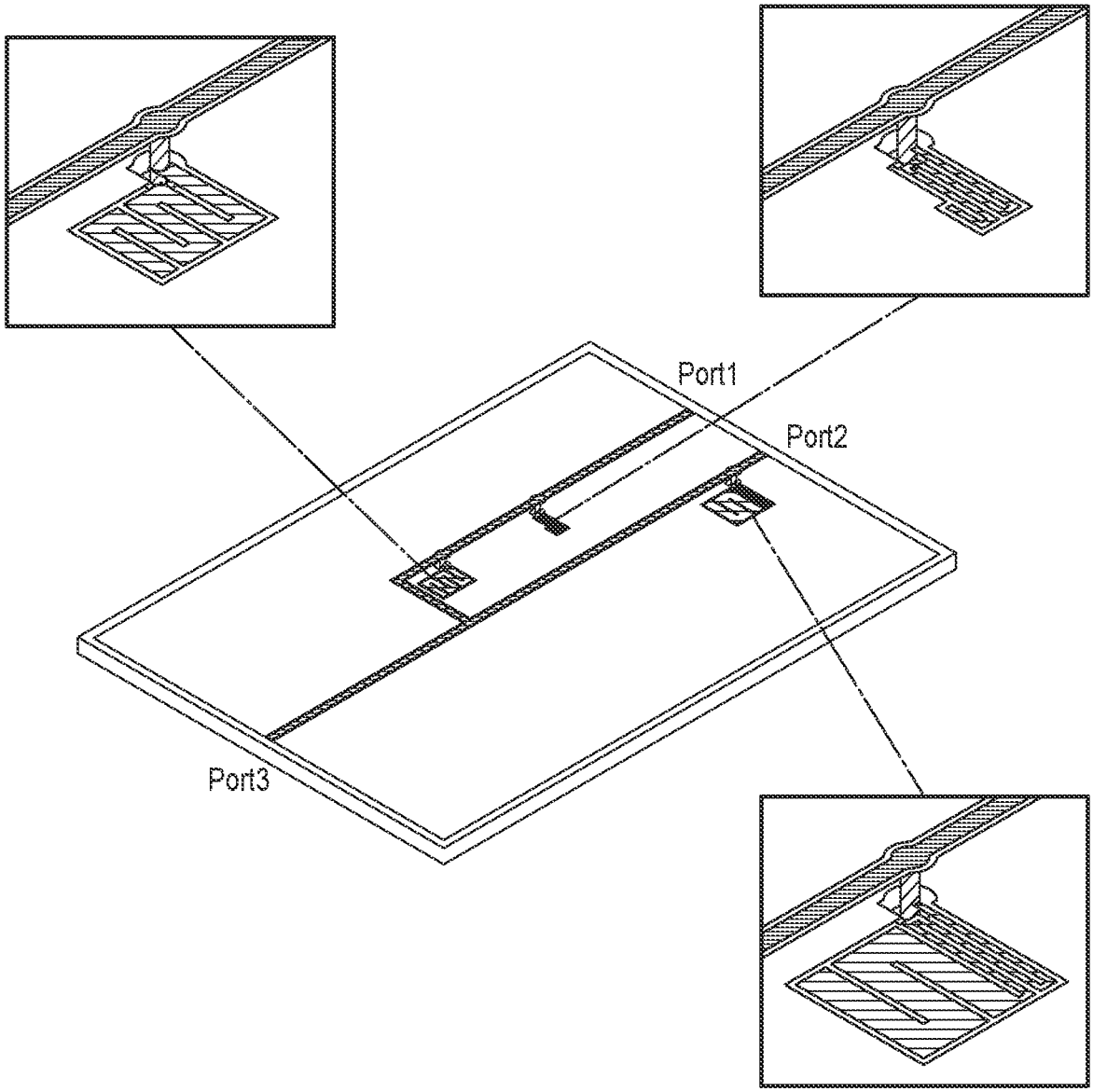
FIGS. 16A and 16B are a view showing an example of the second arrangement of the branch circuit and a graph showing the characteristics the branch circuit, respectively.
Figure 16B:
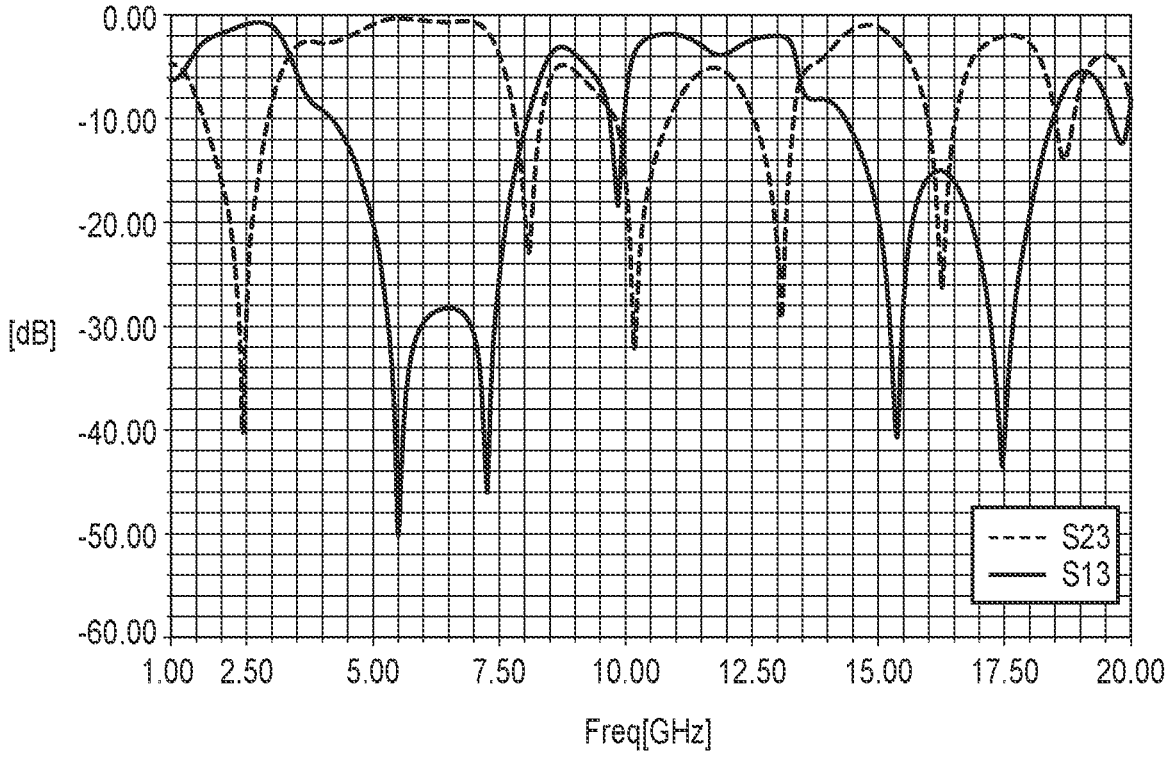

FIGS. 16A and 16B show the arrangement example of a branch circuit when the stub of FIG. 19A is arranged in the first conductor and its characteristics, respectively. The arrangement of FIG. 16A is an arrangement in which a stub for stopping the propagation of the third harmonic of 7.2 GHz to 7.5 GHz which can be output from the first transmission/reception circuit unit for outputting an electromagnetic wave in the 2.4-GHz band has been additionally arranged in the arrangement example A shown in FIG. 15A. In FIG. 16B, it can be understood from seeing the transmission coefficient S13 between Port3 and Port1 that an attenuation of 25 dB or more has been ensured in the range of 7.2 GHz to 7.5 GHz which is the third harmonic frequency band. Also, an attenuation of 15 dB or more can be ensured for an electromagnetic wave of 4.8 to 5 GHz which is the second harmonic by the stub of FIG. 14A described in the arrangement example A.

As described above, according to the structure of this arrangement example, the second and third harmonics that can be output from the first transmission/reception circuit unit can be stopped from being propagated between Port1 and Port3 to which the antenna is to be connected.

Arrangement Example C

This arrangement example further develops the arrangement described in the arrangement example B, and describes an arrangement of a branch circuit in which suppression of a harmonic component that can be output from the second transmission/reception circuit unit has been considered. Note that a description of the same arrangements as those of the arrangement example B will be omitted.

The second transmission/reception circuit unit can output an electromagnetic wave in the 5-GHz band which is the fundamental wave, but it can also simultaneously output an electromagnetic wave of 10 GHz to 12 GHz which is the second harmonic and an electromagnetic wave of 15 GHz to 18 GHz which is the third harmonic. In FIG. 16B, upon observing the transmission coefficient S23 between Port3 and Port2 in the arrangement example, it is apparent that the loss is 5 dB depending on the frequency in the range of 10 GHz to 12 GHz which is the frequency range of the second harmonic, and that the loss is 1 dB depending on the frequency in the range of 15 GHz to 18 GHz which is the frequency range of the third harmonic. That is, in the branch circuit shown in FIG. 16A, the second and third harmonics output from the second transmission/reception circuit unit can be propagated to Port3 without large attenuation.

Figure 20A:
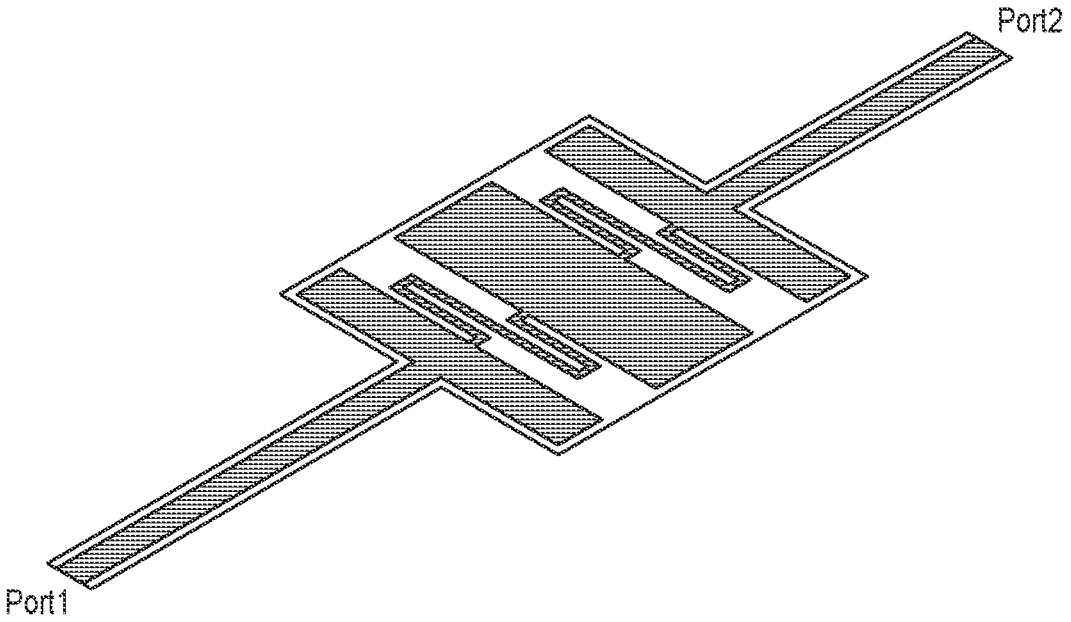
FIGS. 20A and 20B are a view showing an example of a low pass filter according to the examples of the third and fourth arrangements of the branch circuit and a graph showing the characteristics of the branch circuit, respectively.
Figure 20B:
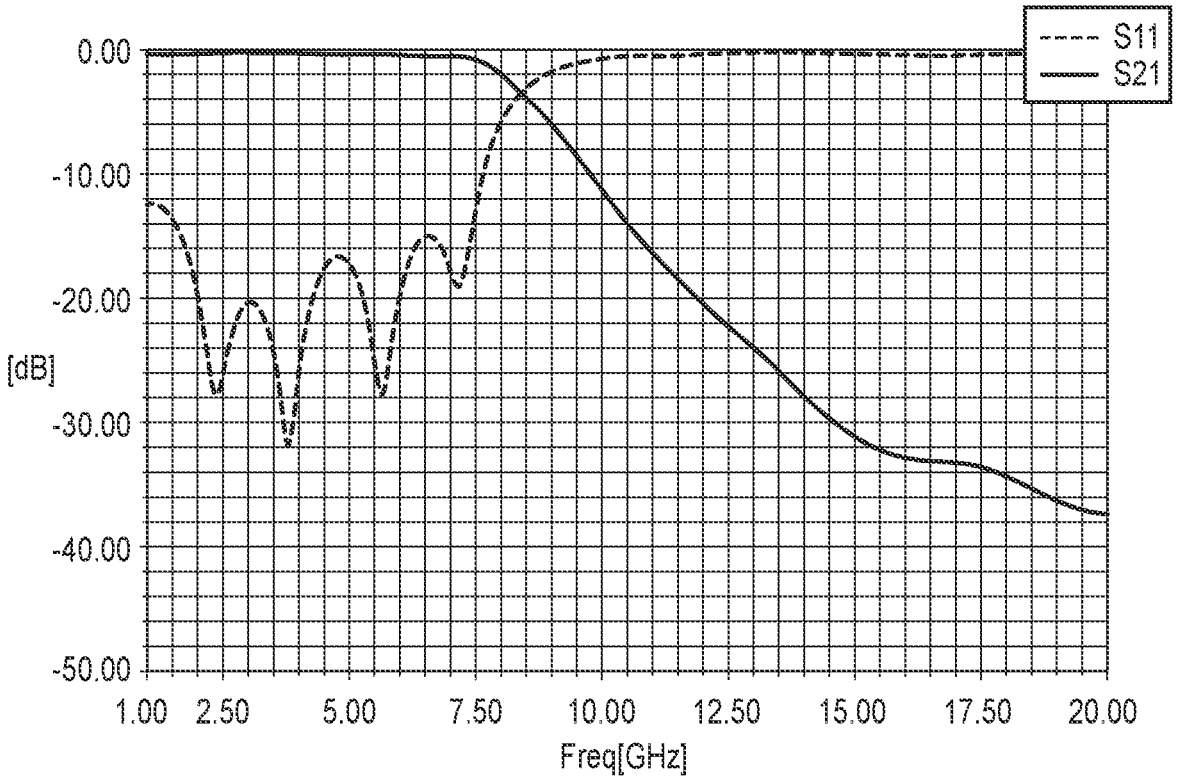

In order to prevent the harmonics that can be generated from the second transmission/reception circuit unit from being input to Port3, this arrangement example combines the arrangement of the arrangement example B and a low pass filter for stopping the propagation of harmonics. FIGS. 20A and 20B show the arrangement of a conductor that is to operate as a low pass filter for stopping the propagation of the second harmonic (10 GHz to 12 GHz) and the third harmonic (15 GHz to 18 GHz) which can be generated from the second transmission/reception circuit unit, and its characteristics, respectively. The low pass filter shown in FIG. 20A is formed by two lines that have different line widths from each other. In this arrangement, lines with the large line width function as parallel capacitor components (C elements) and lines with a smaller line width function as series inductor components (L elements). That is, the arrangement of FIG. 20A functions as three capacitor components in parallel and two inductor components in series. The low pass filter is implemented by the five L and C elements arranged in this manner. In practice, as shown in FIG. 20B, it can be seen that the transmission coefficient S21 between Port1 and Port2 is reduced in a frequency higher than 7.5 GHz by the arrangement of FIG. 20A.

Figure 17A:
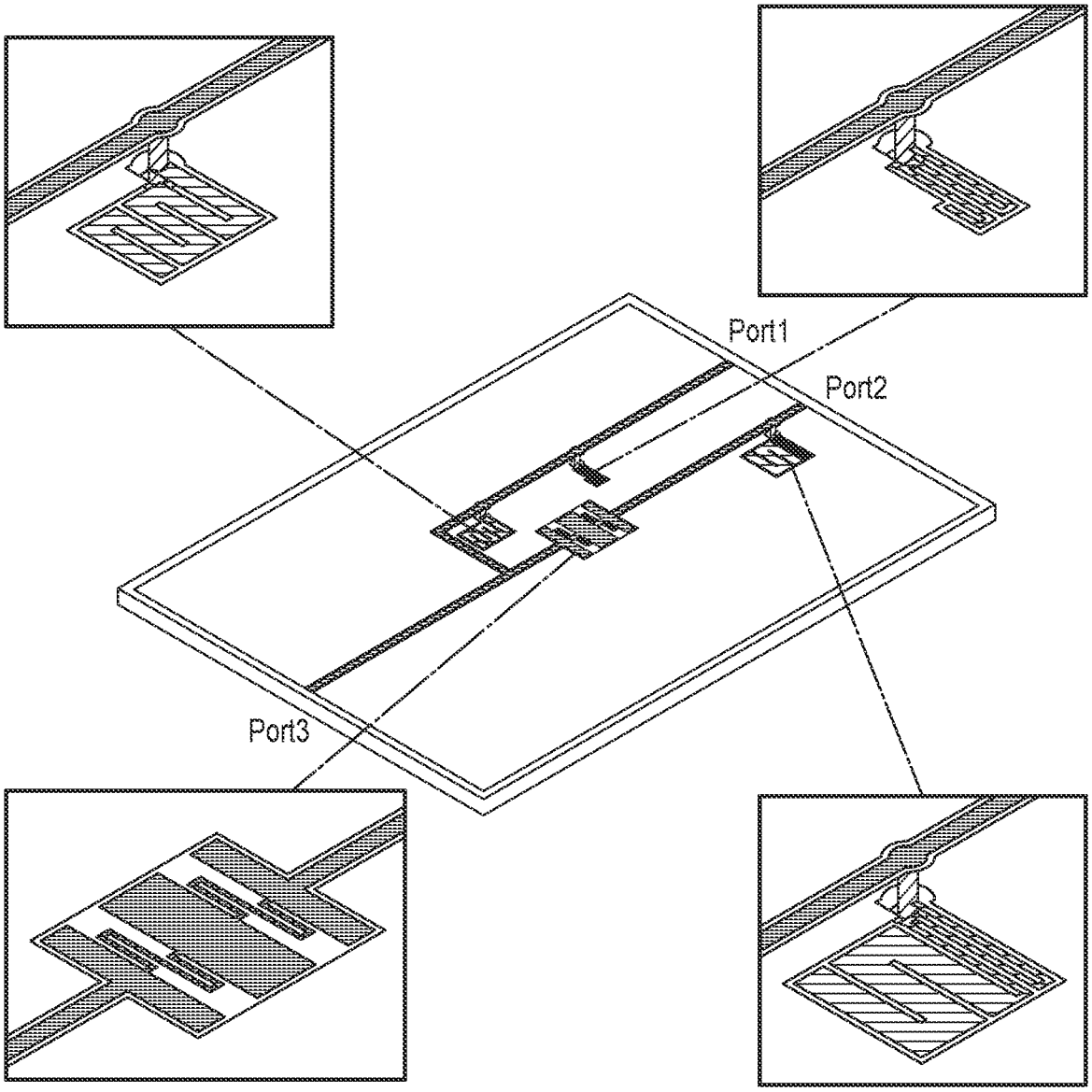
FIGS. 17A and 17B are a view showing an example of the third arrangement of the branch circuit and a graph showing the characteristics the branch circuit, respectively.
Figure 17B:
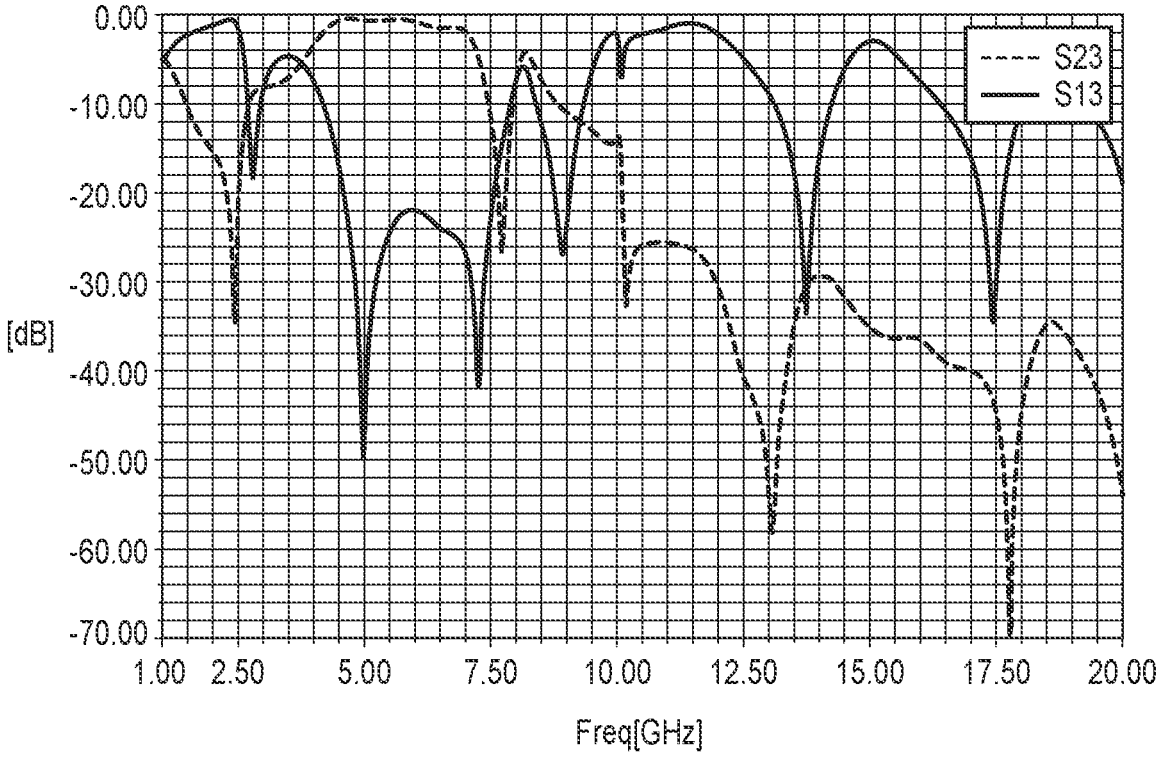

FIGS. 17A and 17B show the arrangement of a branch circuit including the low pass filter of FIG. 20A and its characteristic, respectively. The arrangement of FIG. 17A is an arrangement in which the low pass filter shown in FIG. 20A has been additionally arranged in the second conductor of the arrangement example B shown in FIG. 16A. In FIG. 17B, it can be understood from the transmission coefficient S23 between Port3 and Port2 that an attenuation of 14 dB or more in the range of 10 GHz to 12 GHz which is the frequency range of the second harmonic and an attenuation of 35 dB or more in the range of 15 GHz to 18 GHz which is the frequency range of the third harmonic are ensured. That is, the propagation of the second harmonic (10 GHz to 12 GHz) and the third harmonic (15 GHz to 18 GHz) that may be transmitted from the second transmission/reception circuit unit is stopped by the low pass filter that is arranged on the branch circuit.

Figure 21A:
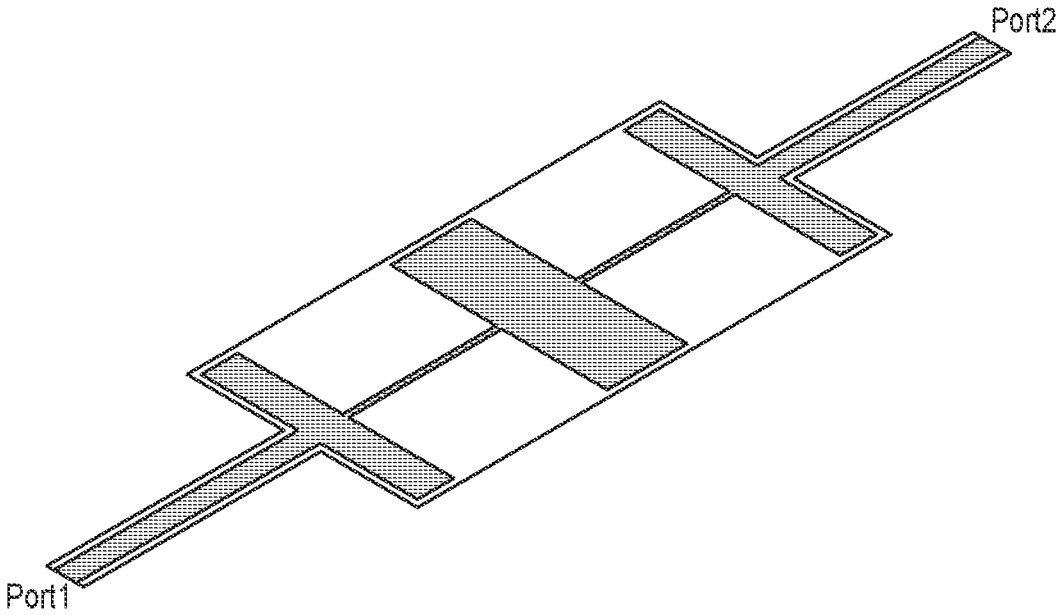
FIGS. 21A and 21B are a view showing an example of the low pass filter according to the examples of the third and fourth arrangements of the branch circuit and a graph showing the characteristics of the branch circuit, respectively.
Figure 21B:
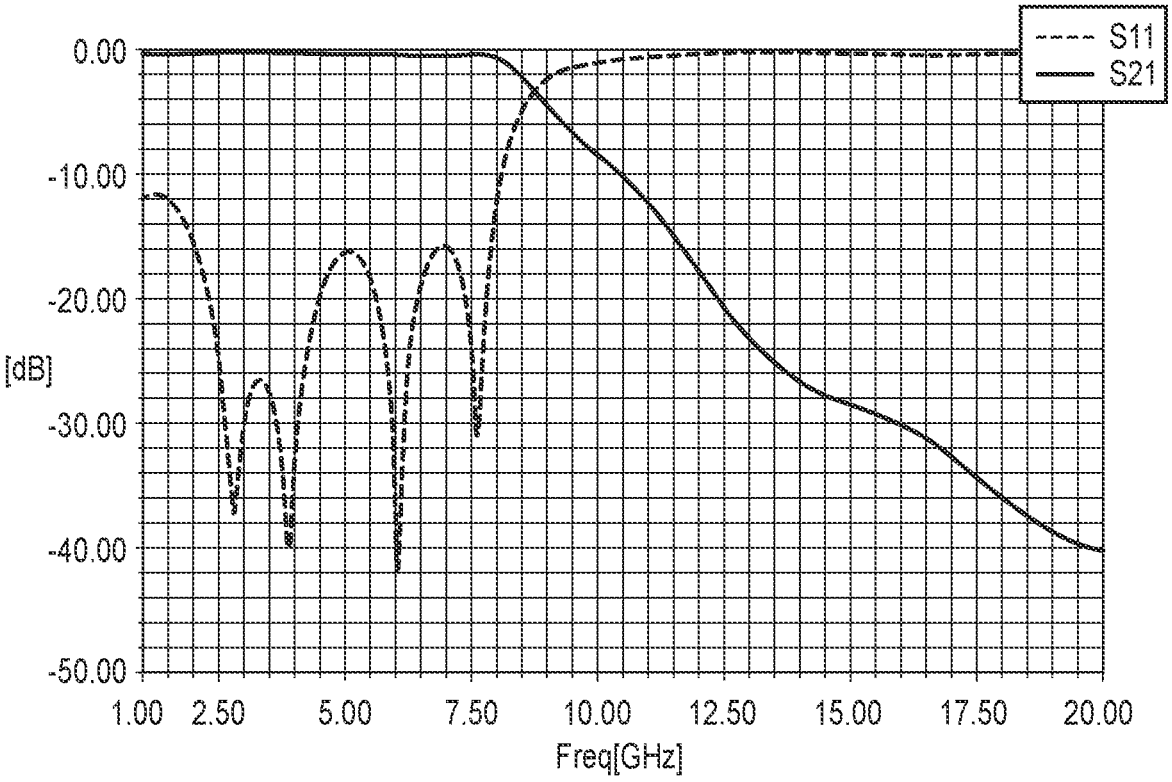

Note that although each line with the smaller line width for forming the L element is assumed to have a meander shape for the sake of downsizing in this arrangement example, a linear line may be used as shown in FIG. 21A. In this case as well, the function as the low pass filter can be obtained, as shown in FIG. 21B, in the same manner as the arrangement of FIG. 20A. The number of C elements and the number of L elements to be formed by the lines with different line widths are not limited to three and two, respectively. It is possible to use a desired number C elements and a desired number of L elements to implement the desired low pass filter characteristic. For example, the low pass filter may be formed by a $\pi$ filter which is formed so that one L element is held between two C elements or a T filter which is formed so that one C element is held between two L elements. In addition, although this arrangement example used lines with two different line widths to form the C element and L element, it is possible to use lines with three or more different line widths. Furthermore, although this arrangement example assumed that the low pass filter will be formed in the same layer as the layer in which the second conductor is formed, the low pass filter may be formed in a different layer.

Arrangement Example D

This arrangement example further develops the arrangement described in the arrangement example B, and describes an arrangement of a branch circuit in which suppression of harmonic components that can be output from the first transmission/reception circuit unit and the second transmission/reception circuit unit has been considered. In this arrangement example, a low pas filter for stopping the propagation of harmonics is arranged on the third conductor of the arrangement example B so harmonics that can be generated from the first transmission/reception circuit unit and the second transmission/reception circuit unit will not be input to Port3. This arrangement will use the low pass filter shown in FIG. 20A.

Figure 18A:
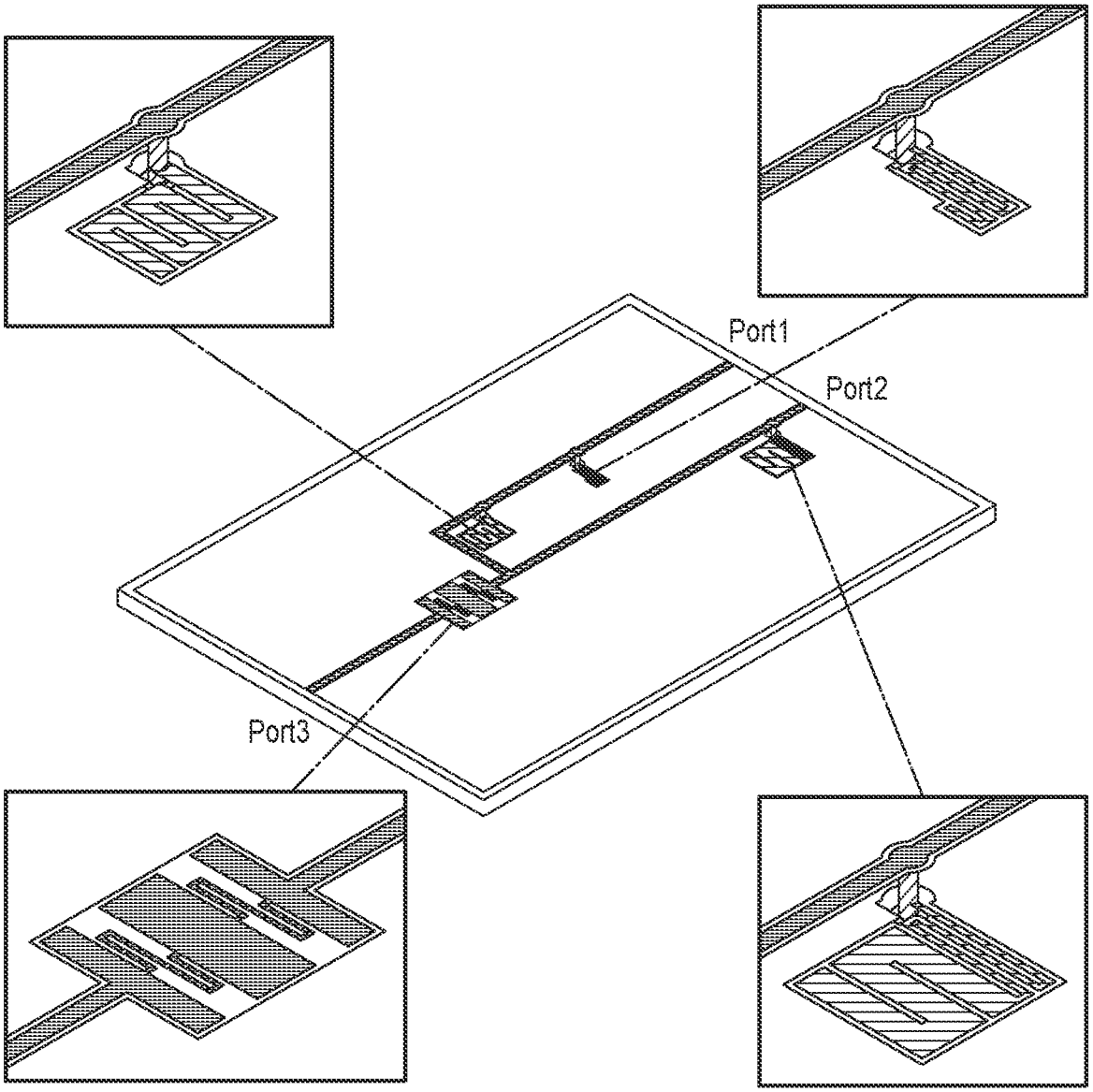
FIGS. 18A and 18B are a view showing an example of the fourth arrangement of the branch circuit and a graph showing the characteristics the branch circuit, respectively.
Figure 18B:
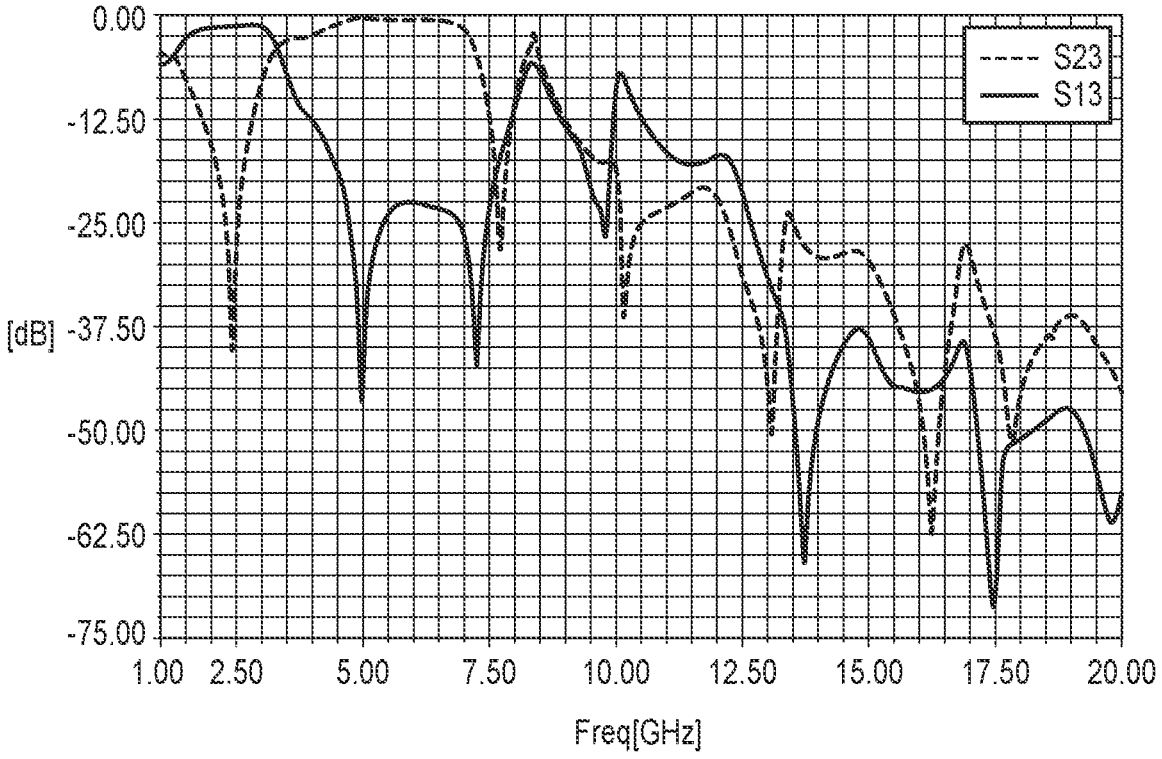

FIGS. 18A and 18B show the arrangement example of a branch circuit when the low pass filter has been arranged on the third conductor and the characteristic of this arrangement, respectively. By arranging the low pass filter on the third conductor, it is apparent from FIG. 18B that attenuation can be ensured in the high frequency band in not only the transmission coefficient S23 between Port2 and Port3 but also in the transmission coefficient S13 between Port1 and Port3. That is, the arrangement of FIG. 18A can stop the propagation of harmonics higher than the third harmonic that can be output from the first transmission/reception circuit unit.

As described above, it is possible to prevent harmonics that may be output from the first and second transmission/reception circuit units from propagating between Port3 and Port1 or Port2 in the branch circuit that has a diplexer function.

Other Arrangement Examples

In the arrangement examples A to D, a band stop filter which is to be arranged in the branch circuit that has the diplexer function used a meander-shaped structure that included many bent portions. However, it is possible to use a band stop filter which has another shape such as the band stop filters described in, for example, the arrangement examples 1 to 3. The shape is also not limited to these shapes, and any kind of shape such as a shape with fewer bent portions, a linear shape, an arc shape, or the like may be used. The first conductor, the second conductor, and the third conductor each may be formed, for example, by a line that has a plurality of bent portions such as a meander shape. This allows downsizing to be performed by shortening the total length in one direction of the branch circuit.

In addition, although each of the arrangement examples A to D described a case in which the band stop filter is formed in a different layer (third layer) from that of a line, the band filter may be formed in the same layer (first layer) as the line. Also, although a case in which a low pass filter is arranged on the same layer (first layer) as the line has been described, the low pass filter may be arranged on a different layer from that of the line. Furthermore, it may be arranged so that the first conductor, the second conductor, and the third conductor are arranged on different layers from each other. This can raise the degree of freedom when the circuit pattern of the branch circuit that has the diplexer function is to be designed.

Each of the arrangement examples A to D also described a branch circuit that has a function of a diplexer which serves as a three-port filter separating two frequency bands. This method is applicable to, for example, a branch circuit which has a triplexer function of separating three different frequency bands and a branch circuit that separates four or more different frequency bands. That is, by connecting one or more conductor structures, for stopping the propagation of an electromagnetic wave of a frequency band which is to be propagated through another branch line, to a position, in each branch line, corresponding to the frequency characteristic, it allows the propagation of a signal component in a predetermined frequency band while stopping the propagation of a signal component in another frequency band.

A stub may be arranged for one or more conductors among the two or more conductors that have been branched. For example, in a case in which one branch path is used for signal measurement in a three-port diplexer that separates two frequency bands, a stub need not be arranged on a transmission line that does not need a specific frequency component of an electromagnetic wave to be cut off.

In addition, although the branch circuit in each of the arrangement examples A to D was described as a transmission line for signal propagation, the branch circuit may be another branch circuit such as a power supply circuit.

Furthermore, the present invention is applicable to a substrate other than the four-layer substrate shown in FIG. 8. For example, the present invention is applicable to a substrate with fewer layers such as a two-layer substrate.

Note that although the transmission characteristic S13 was used as the transmission characteristic between Port3 and Port1 in each description of the arrangement examples A to D, it has been confirmed that the transmission characteristic S13 and a transmission characteristic S31 are almost the same. In the same manner, although the transmission characteristic S23 was used as the transmission characteristic between Port3 and Port2 in each description, it has been confirmed that the transmission characteristic S23 and a transmission characteristic S32 also are almost the same. Hence, it is possible to prevent a predetermined frequency component of an electromagnetic wave to be propagated from Port3 to Port1 and an electromagnetic wave of the predetermined frequency component to be propagated from Port1 to Port3 from flowing into Port2 together without being greatly attenuated. In the same manner, it is possible to prevent a predetermined frequency component of an electromagnetic wave to be propagated from Port3 to Port2 and an electromagnetic wave of the predetermined frequency component to be propagated from Port2 to Port3 from flowing into Port1 together without being greatly attenuated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-229364, filed on Nov. 29, 2017, which is hereby incorporated by reference herein in its entirety.

What is claimed is:

1. A branch circuit comprising:

a first conductor and a second conductor as at least two branches from a predetermined branch point;

a first stub which is connected to the first conductor at a first point; and a second stub which is connected to the second conductor at a second point, wherein the first point is a point where a length of a portion between the predetermined branch point and the first point of the first conductor is set to a first length which is determined in accordance with a characteristic of the first stub, wherein the second point is a point where a length of a portion between the predetermined branch point and the second point of the second conductor is set to a second length which is determined in accordance with a characteristic of the second stub and is different from the first length, wherein at least one of the first stub and the second stub includes a linear conductor portion, and wherein in the linear conductor portion, a first portion which includes an end to be connected to one of the first conductor and the second conductor has a first width, and a second portion which is different from the first portion has a second width different from the first width.

2. The circuit according to claim 1 wherein the characteristic of the first stub is determined in accordance with a frequency of an electromagnetic wave which is to be propagated through the second conductor.

3. The circuit according to claim 1 wherein the characteristic of the second stub is determined in accordance with a frequency of electromagnetic wave which is to be propagated through the first conductor.

4. The circuit according to claim 1, wherein in a case in which the first stub includes the first portion and the second portion, one of a ratio between a length of the first portion and a length of the second portion and a ratio between a line width of the first portion and a line width of the second portion of the first stub is determined in accordance with a frequency of an electromagnetic wave to be propagated through the first conductor.

5. The circuit according to claim 1, wherein in a case in which the second stub includes the first portion and the second portion, one of a ratio between a length of the first portion and a length of the second portion and a ratio between a line width of the first portion and a line width of the second portion of the first stub is determined in accordance with a frequency of an electromagnetic wave to be propagated through the second conductor.

6. The circuit according to claim 1, wherein the first width is smaller than the second width.

7. The circuit according to claim 1, wherein the first stub is formed in a layer different from that of the first conductor.

8. The circuit according to claim 1, wherein the second stub is formed in a layer different from that of the second conductor.

9. A branch circuit comprising:

a first conductor and a second conductor as at least two branches from a predetermined branch point;

a first stub which is connected to the first conductor at a first point;

a second stub which is connected to the second conductor at a second point;

a port where at least one of input and output of an electromagnetic wave to the branch circuit is performed; and a third conductor which connects the port and the predetermined branch point, wherein the first point is a point where a length of a portion between the predetermined branch point and the first point of the first conductor is set to a first length which is determined in accordance with a characteristic of the first stub, wherein the second point is a point where a length of a portion between the predetermined branch point and the second point of the second conductor is set to a second length which is determined in accordance with a characteristic of the second stub and is different from the first length, and wherein the third conductor further includes a third portion that has a third width and a fourth portion that has a fourth width different from the third width.

10. The circuit according to claim 9, wherein one third portion is held between two fourth portions.

11. The circuit according to claim 9, wherein the third width is smaller than the fourth width.

12. The circuit according to claim 9, wherein the third width is larger than the fourth width.

13. A branch circuit comprising:

a first conductor and a second conductor as at least two branches from a predetermined branch point;

a first stub which is connected to the first conductor at a first point;

a second stub which is connected to the second conductor at a second point; and a third conductor which is arranged around the first stub and the second stub, wherein the first point is a point where a length of a portion between the predetermined branch point and the first point of the first conductor is set to a first length which is determined in accordance with a characteristic of the first stub, and wherein the second point is a point where a length of a portion between the predetermined branch point and the second point of the second conductor is set to a second length which is determined in accordance with a characteristic of the second stub and is different from the first length.

* * * * *